US009796187B2

(12) United States Patent
Qin et al.

(10) Patent No.: US 9,796,187 B2
(45) Date of Patent: Oct. 24, 2017

(54) METHOD FOR CONTROLLING LIGHT EMISSION OF INK CARTRIDGE, AND INK CARTRIDGE

(71) Applicant: ZHUHAI NINESTAR MANAGEMENT CO., LTD., Zhuhai (CN)

(72) Inventors: Lei Qin, Zhuhai (CN); Zhizheng Jia, Zhuhai (CN); Weichen Liu, Zhuhai (CN); Yuedan Liang, Zhuhai (CN)

(73) Assignee: ZHUHAI NINESTAR MANAGEMENT CO., LTD., Zhuhai, Guangdong (CN)

( * ) Notice: Subject to any disclaimer, the term of this patent is extended or adjusted under 35 U.S.C. 154(b) by 0 days.

(21) Appl. No.: 15/236,437

(22) Filed: Aug. 14, 2016

(65) Prior Publication Data

US 2016/0375692 A1 Dec. 29, 2016

Related U.S. Application Data

(63) Continuation-in-part of application No. 14/752,809, filed on Jun. 26, 2015, now Pat. No. 9,446,598, which (Continued)

(30) Foreign Application Priority Data

Dec. 27, 2012 (CN) ..... 2012 1 0579548
Dec. 27, 2012 (CN) ..... 2012 2 0736126 U

(51) Int. Cl.
*B41J 2/175* (2006.01)

(52) U.S. Cl.
CPC ..... *B41J 2/17566* (2013.01); *B41J 2/1753* (2013.01); *B41J 2/17503* (2013.01); (Continued)

(58) Field of Classification Search
CPC ... B41J 2/17543; B41J 2/17546; B41J 2/1753
See application file for complete search history.

(56) References Cited

U.S. PATENT DOCUMENTS 7,455,382 B2 11/2008 Kuribayashi et al.
2006/0082625 A1 4/2006 Kotaki et al.
(Continued)

FOREIGN PATENT DOCUMENTS

CN 1883954 A 12/2006
CN 100389961 C 5/2008
(Continued)

OTHER PUBLICATIONS

International Search Report of corresponding International PCT Application No. PCT/CN2013/080037, dated Oct. 31, 2013.
(Continued)

*Primary Examiner* — Jason Uhlenhake
(74) *Attorney, Agent, or Firm* — Metis IP LLC

(57) ABSTRACT

Disclosed is a method and an apparatus for controlling light emission of an ink cartridge. The method includes: an ink cartridge control unit (304), configured to receive a light emitting control instruction from an imaging device main body and identifying the instruction; the ink cartridge control unit (304), configured to control light emission of a light emitting unit (303) of the ink cartridge (10) according to the identified light emitting control instruction and preset control information corresponding to the light emitting control instruction so that the light emitting unit (303) does not emit light at an adjacent position light detection stage but emits light at an facing position light detection stage.

20 Claims, 16 Drawing Sheets

Related U.S. Application Data is a continuation of application No. PCT/CN2013/080037, filed on Jul. 24, 2013.

(52) U.S. Cl.
CPC ..... *B41J 2/17513* (2013.01); *B41J 2/17546* (2013.01); *B41J 2/17553* (2013.01); *B41J 2002/17573* (2013.01)

(56) References Cited

U.S. PATENT DOCUMENTS

| | | | | |
|---|---|---|---|---|
| 2006/0284907 | A1 | 12/2006 | Ikeda et al. | |
| 2008/0279568 | A1* | 11/2008 | Sugiura | B41J 2/17526 399/12 |
| 2012/0081425 | A1* | 4/2012 | Ochiai | B41J 2/17546 347/7 |

FOREIGN PATENT DOCUMENTS

| | | | |
|---|---|---|---|
| CN | 203004519 | U | 6/2013 |
| CN | 203004525 | U | 6/2013 |
| CN | 203004526 | U | 6/2013 |
| CN | 203004527 | U | 6/2013 |
| CN | 103786442 | A | 5/2014 |
| EP | 2332727 | A1 | 6/2011 |

OTHER PUBLICATIONS

Chinese First Examination Report of corresponding China patent application No. 201210579548.7 dated Jul. 28, 2015.
Notification of Reasons for Refusal for Japanese application No. 2015-549952 dated Aug. 26, 2016, 4 pages.
Extended European Search Report for European application No. 13866525.2 dated Feb. 1, 2017, 8 pages.

* cited by examiner

METHOD FOR CONTROLLING LIGHT EMISSION OF INK CARTRIDGE, AND INK CARTRIDGE

CROSS-REFERENCE TO RELATED APPLICATIONS

This application is a continuation-in-part of U.S. patent application Ser. No. 14/752,809 filed on Jun. 26, 2015, which is a continuation of International Application No. PCT/CN2013/080037, filed on Jul. 24, 2013, which claims the priority benefit of China Patent Application No. 201210579548.7 filed on Dec. 27, 2012 and China Patent Application No. 201220736126.1 filed on Dec. 27, 2012. Each of the above-referenced applications is expressly incorporated herein by reference to their entireties.

FIELD OF THE TECHNOLOGY

The present invention relates to ink-jet technologies and, in particular, to a method and an apparatus for controlling light emission of an ink cartridge.

BACKGROUND

An imaging device is a common tool in peoples' current work and life, such as a printer, a photocopier, a facsimile machine. The imaging device generally includes two parts, an imaging device main body and an ink cartridge; the ink cartridge is a consumable item, which is thus detachably mounted generally in the imaging device main body to be easily replaced. Moreover, in order to allow the imaging device to be used for a long term or be adaptable to requirements for different colors of the ink cartridge, a plurality of ink cartridges may be provided in a current imaging device. Correspondingly, in order to make sure respective ink cartridges are mounted in a correct position of the imaging device main body, an ink cartridge position detection technique is proposed.

In the prior art, ink cartridge position detection, for instance, generally in the manner of light emitting control, is implemented by controlling light emission of a light source in an ink cartridge, specifically, the ink cartridge is provided with a light source, a light receiver is provided in the imaging device main body; the ink cartridge position detection includes two stages, a facing position detection and an adjacent position detection, at the stage of facing position detection, a position of a to-be-detected ink cartridge is arranged on the facing position of the light receiver, and then the light source of the ink cartridge is controlled to emit light, the light receiver receives the light and records the light emission amount; subsequently, at the adjacent position detection stage, an ink cartridge adjacent to the to-be-detected ink cartridge is controlled to emit light, the light receiver receives the light and records the light emission amount. If the light emission amount of the to-be-detected ink cartridge at the facing position is greater than a preset threshold value, and the light emission amount of the to-be-detected ink cartridge is greater than the light emission amount of the adjacent ink cartridge, then the imaging device main body may determine whether the mounting position of the to-be-detected ink cartridge is correct based on this.

However, the above method of the ink cartridge position detection has some defects: during the actual manufacturing process of the cartridge, there will inevitably be some manufacturing errors so the light emission amount of light sources on the respective ink cartridges of the imaging device cannot be equivalent, so in the case that the light emission amount of the adjacent ink cartridge at the adjacent position detection stage is equal to or greater than the light emission amount of the to-be-detected ink cartridge at the facing position detection stage, this will cause an false detection of ink cartridge position detection.

SUMMARY

The present invention provides a method and an apparatus for controlling light emission of an ink cartridge to reduce false report rate during a process of ink cartridge position detection.

In a first aspect, a method for controlling light emission of an ink cartridge is provided, where an ink cartridge control unit is provided on an ink cartridge removably mountable to an imaging device main body, and the imaging device main body is provided with an light receiver, the ink cartridge further includes an electric interface unit for receiving a signal transmitted by the imaging device main body and a storage unit for storing ink cartridge identification information, the ink cartridge control unit is connected to alight emitting unit emitting light towards the light receiver to control the light emitting unit to emit or not emit light, and the imaging device main body is provided with at least two ink cartridges; the method comprises:

Receiving, by the ink cartridge control unit, a light emitting control instruction from the imaging device main body and identifying the instruction; and Controlling, by the ink cartridge control unit, the light emission of the light emitting unit of the ink cartridge according to the identified light emitting control instruction and preset control information corresponding to the light emitting control instruction, so that the light emitting unit does not emit light at an adjacent position light detection stage of a to-be-detected ink cartridge, but emits light at an facing position light detection stage of the to-be-detected ink cartridge.

In a second aspect, an ink cartridge control unit for controlling light emission of an ink cartridge is provided, the ink cartridge control unit is provided on an ink cartridge removably mountable to an imaging device main body, the imaging device main body is provided with at least two ink cartridges; and the imaging device main body is provided with an light receiver, the ink cartridge further includes an electric interface unit for receiving a signal transmitted by the imaging device main body and a storage unit for storing ink cartridge identification information, the ink cartridge control unit is connected to a light emitting unit to control the light emission of the light emitting unit, and the light emitting unit emits light towards the light receiver, the ink cartridge control unit comprises:

an instruction identifying unit, configured to receive a controlling instruction of the light emission from the imaging device main body and identify the instruction; and an instruction processing unit, configured to control the light emission of the light emitting unit of the ink cartridge according to the identified light emitting control instruction and preset controlling information corresponding to the light emitting control instruction, so that the light emitting unit does not emit light at an adjacent position light detection stage of a to-be-detected ink cartridge, but emits light at an facing position light detection stage of a to-be-detected ink cartridge.

In a third aspect, a circuit board for controlling light emission of an ink cartridge is provided, including: an electric interface unit for receiving a signal transmitted by an imaging device main body, a storage unit for storing ink cartridge identification information, and an ink cartridge control unit according to the present invention.

In a fourth aspect, an ink cartridge is provided, including an ink cartridge main body, and further including: a circuit board for controlling light emission of an ink cartridge according to the present invention.

The method and the control unit for controlling light emission of an ink cartridge is provided in the present invention has technical effects: an ink cartridge control unit in an ink cartridge controls light emission of a light emitting unit of the ink cartridge according to the identified light emitting control instruction and preset control information corresponding to the light emitting control instruction, so that the light emitting unit does not emit light at an adjacent position light detection stage of a to-be-detected ink cartridge, but emits light at an facing position light detection stage of a to-be-detected ink cartridge, so that it may be ensured that the light emission amount of adjacent to the to-be-detected ink cartridge is less than the light emission amount of the to-be-detected ink cartridge, and even if the light emission amount of light sources in respective ink cartridges is not strictly maintained equal to each other due to a manufacturing error, it can also be ensured that light emission amount of the adjacent ink cartridge is less than light emission amount of the to-be-detected ink cartridge, and thus the case that light emission amount of the adjacent ink cartridge is equal to or greater than light emission amount of the to-be-detected ink cartridge can be avoided, thereby reducing a false report rate of ink cartridge position detection.

BRIEF DESCRIPTION OF THE DRAWINGS

FIG. 2*a* is a second schematic structural diagram of the chip on the ink cartridge as shown in FIG. 1*a;*

DETAILED DESCRIPTION

In order to make technical solutions of embodiments of the present invention clearer and easily understood, a typical ink cartridge and a connecting structure between the ink cartridge and an imaging device main body are described firstly; persons skilled in the art should understand that, the embodiments of the present invention are applicable to an ink cartridge, but not limited to the ink cartridge structures described hereunder. Moreover, a common method for ink cartridge position detection is also briefly described.

Figure 1A:
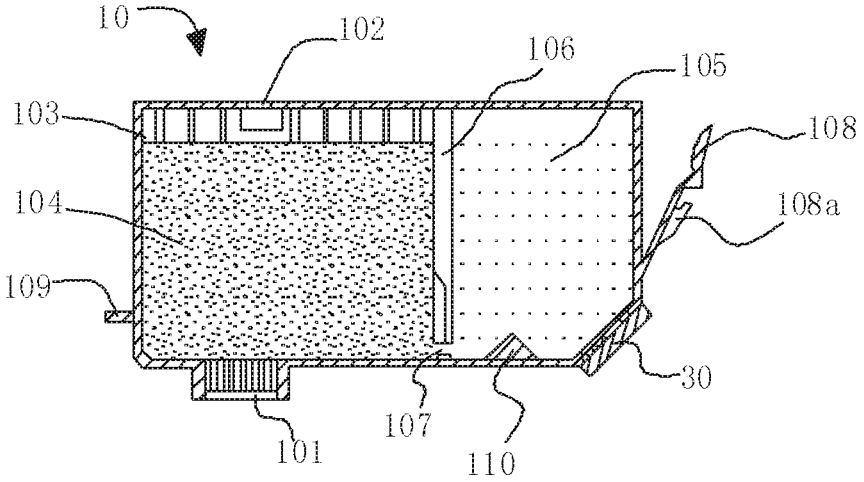
FIG. 1*a* is a schematic structural diagram of an ink cartridge applied in an embodiment of the present invention.
Figure 1B:
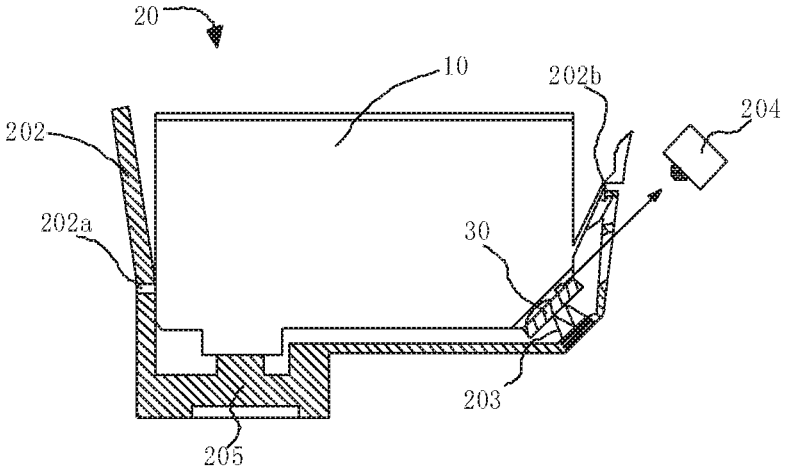
FIG. 1*b* is a schematic structural diagram of mounting the ink cartridge as shown in FIG. 1*a* into an imaging device main body.
Figure 1C:
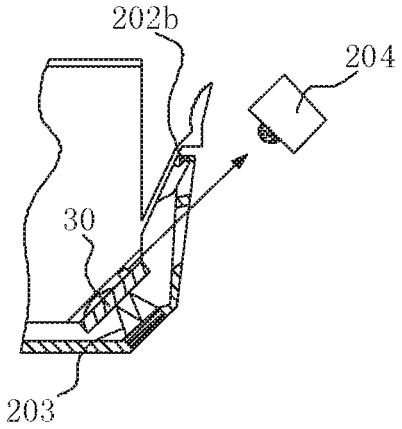
FIG. 1*c* is an enlarged schematic view of a local structure as shown in FIG. 1*b;*

FIG. 1*a* is a schematic structural diagram of an ink cartridge applied in an embodiment of the present invention, and FIG. 1*b* is a schematic structural diagram of mounting the ink cartridge as shown in FIG. 1*a* into an imaging device main body, to form an imaging device, which will be described by taking an ink jet printer as an example. FIG. 1*c* is an enlarged schematic view of a local structure as shown in FIG. 1*b*.

As shown in FIG. 1*a*, an ink cartridge 10 includes a cartridge body and a cartridge lid, both of which are prepared from plastics, and connected integrally by way of such as thermal welding or friction welding, and a chamber is formed inside thereof. The chamber of the ink cartridge 10 is partitioned into a negative pressure chamber 103 and an ink chamber 105 by a partition wall 106, both of which are in communication with each other via an intercommunicating pore 107 below the partition wall 106. The ink chamber 105 is contained with ink to be supplied to the printer, and the negative pressure chamber 103 is placed with a negative pressure generating member such as a porous body to control negative pressure within the ink cartridge 10, the porous body described above is preferably a sponge 104. Persons having ordinary skill in the art should understand that, the above negative pressure generating member may also be other valve body controlling ink flow or air flow, and may be selected according to a specific application of the ink cartridge; furthermore, the chamber inside the ink cartridge may also be arranged according to a specific need, and is not limited to the separation structure described above.

With reference to FIG. 1*b*, the ink cartridge 10 is removably mountable to an ink jet printer 20, and is provided with a support member 108 rotatable around a pivot at a rear side wall, the support member 108 is prepared from a resin material which is integrally moulded with the housing of the ink cartridge 10. Moreover, a front side wall and a rear side wall of the ink cartridge 10 are formed with a first engaging portion 109 and a second engaging portion 108*a* respectively, which adapted to be engaged with locking structures 202*a*, 202*b* on the ink jet printer 20 respectively to mount the ink cartridge 10 to the ink jet printer 20 securely, and the second engaging portion 108*a* and the support member 108 are integrally formed.

Furthermore, as shown in FIG. 1*a*, the bottom surface of the ink cartridge 10 is provided with an ink outlet 101 for supplying ink to the printer, which is connected to a printing head 205 of the ink jet printer 20 when the ink cartridge 10 is mounted on the ink jet printer 20, as shown in FIG. 1*b*; and an air inlet 102, configured above the negative pressure chamber 103 of the ink cartridge 10 for communicating the inside of the ink cartridge 10 with the external atmosphere. Moreover, as shown the figure, a prism 110 is placed at the bottom of the ink chamber 105 to detect remaining ink of the ink cartridge 10, which a common technology in the art, and will not be repeated herein.

Besides the ink cartridges described above, the ink jet printer further includes the following parts: a carriage unit is configured on the ink jet printer 20 containing the ink cartridge 10 and moving back and forth along the direction of paper recording, an ink cartridge mounting portion 202 secured to the carriage unit to accommodate the ink cartridges 10, several device electrical contacts 203 corresponding to the ink cartridges 10 respectively, a light receiver 204 for receiving light, a circuit (not shown in the figure) connected to the several device electrical contacts 203 via a line and a control circuit (not shown in the figure) for determining whether the ink cartridges 10 are mounted at correct positions according to a receiving result of the receiver 204. Obviously, the several device electrical contacts 203 are connected with each other via a shared line, and after the ink cartridges 10 are mounted to the ink jet printer 20, the ink cartridges 10 are in a bus connection status.

Figure 2A:
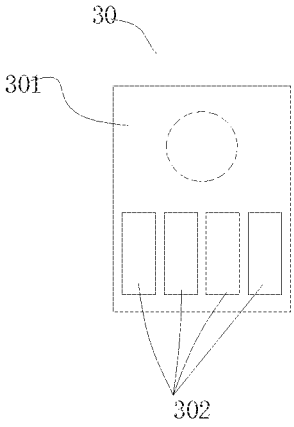
FIG. 2*a* is a first schematic structural diagram of a chip on the ink cartridge as shown in FIG. 1*a;*
Figure 2B:
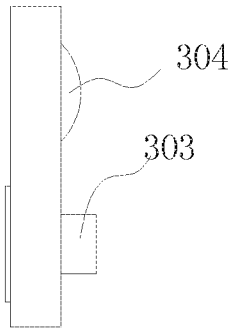

Furthermore, as shown in FIG. 1*a* and FIG. 2*b*, a chip 30 is provided at a corner formed by intersection of a bottom wall and a rear side wall of the ink cartridge 10. FIG. 2*a* and FIG. 2*b* are schematic structural diagrams of a chip on the ink cartridge shown in FIG. 1*a*, the chip 30 includes: a circuit board 301, used for loading various components described hereunder: ink cartridge side electrical contacts 302, a light emitting unit 303, a storage unit and an ink cartridge control unit 304, where the ink cartridge control unit 304 may be a controller, and the storage unit may be integrated into the controller or be configured independently.

The ink cartridge side electrical contacts 302 are formed on the circuit board 301 described above, and may be connected to the corresponding device electrical contacts 203 so as to establish electrical connection between the ink jet printer 20 and the ink cartridge 10 to exchange information, that is, the ink cartridge side electrical contacts 302 are equivalent to an interface unit for receiving a signal transmitted by the printer. Specifically, the ink cartridge side electrical contacts 302 include power contacts for imposing voltage imposed at the printer side to the chip 30 and data contacts for performing data input/output between the data contacts and the ink jet printer 20. The light emitting unit 303, as shown in FIG. 1*c*, for emitting light towards the light receiver 204, preferably, in the following embodiments, is an LED light; moreover, the light emitting unit 303 may be provided on, for instance, a housing of an ink cartridge instead of on the circuit board 301, as long as it can show the position of the ink cartridge and receive light emitted under control of the ink cartridge control unit 304. The storage unit is provided on the circuit board 301, for storing various information related to the ink cartridge 10, such as amount of ink, type of the ink cartridge, color of ink, date of manufacture of the ink cartridge, including ink cartridge identification information, and the storage unit may be selected as various memories such as EEPROM or RAM according to need. The ink cartridge control unit 304 is a controller in this embodiment, as shown in FIG. 2*b*, which is mainly used for controlling the light emitting unit 303 emit light or not according to the light emitting control instructions inputted from the printer via the ink cartridge side electrical contacts 302.

It will be understood by persons of ordinary skill in the art that, the light emitting unit may also be configured as an incandescent lamp or other components that can emit light; the LED lamp can emit light with different wavelengths according to different design requirements, such as visible light or invisible light, and in this embodiment, in order to provide a user with certain reminder, preferably, the LED lamp emits visible light.

Furthermore, the ink cartridge 10 is also pasted with a label (not shown in the figure), the label is provided with the type of the ink cartridge and color mark, and a corresponding color label is pasted on an accommodating cavity of each of the ink cartridge on the ink cartridge mounting portion 202 of the ink jet printer 20, and thus, during mounting, the user only needs to match the color mark of the label of the ink cartridge with the color mark of the ink cartridge mounting portion 202 of the ink jet printer 20, then a proper ink cartridge may be mounted to a correct position.

Figure 3A:
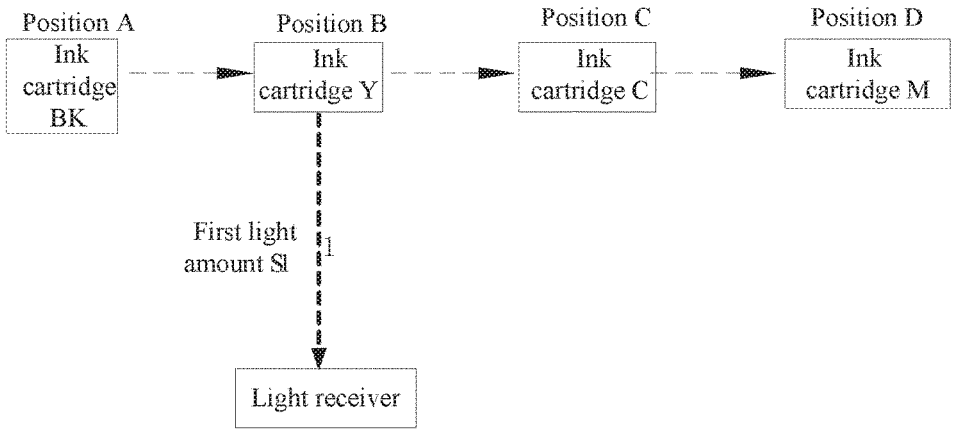
FIG. 3*a* is a first schematic diagram of an ink cartridge position detection principle applied in an embodiment of the present invention.
Figure 3B:
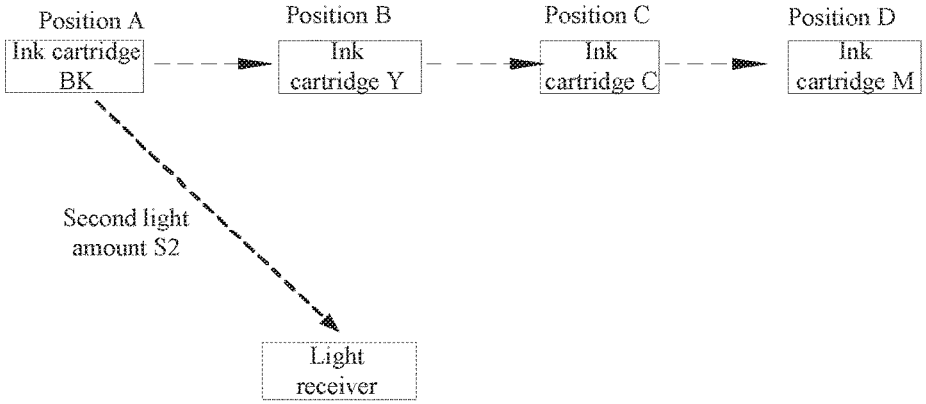
FIG. 3*b* is a second schematic diagram of an ink cartridge position detection principle applied in an embodiment of the present invention.

Taking the ink jet printer according to embodiments of the present invention as an example, a typical ink cartridge position detection solution is described as follows:

In order to ensure normal printing of the ink jet printer, and prevent from a print false report resulting from a wrong mounting position of an ink cartridge, it generally needs to detect whether the ink cartridge is correctly mounted to a proper position of the ink jet printer after the ink cartridge is installed to the printer. FIG. 3*a* and FIG. 3*b* are schematic diagrams of an ink cartridge position detection principle applied in an embodiment of the present invention. As shown in FIG. 3*a*, assuming the ink jet printer is provided with four ink cartridges, for a clear distinction, the ink cartridges are distinguished by color marks, and are marked as black ink cartridge BK, yellow ink cartridge Y, indigo ink cartridge C and magenta ink cartridge M, respectively. The respective ink cartridges are mounted to corresponding ink cartridge mounting positions respectively, and the correct positions thereof are as shown in FIG. 3*a*, respectively position A, position B, position C and position D. The ink jet printer is provided with a light receiver having a fixed position, and the ink cartridge is moved by moving the carriage unit, thereby altering position of the light emitting unit on the ink cartridge in relative to the light receiver on the printer.

Position detection mainly includes two parts: facing position light detection of a current to-be-detected ink cartridge and adjacent position light detection of an adjacent ink cartridge, each of the ink cartridges in an imaging device needs to be taken as the to-be-detected ink cartridge to be detected. The facing position light detection refers to a process where the printer drives the light emitting unit of the to-be-detected ink cartridge facing to the light receiver to emit light, and detects whether the amount of light received by the light receiver is greater than a preset value, and the adjacent position light detection refers to a process where the to-be-detected ink cartridge is maintained at a position facing the light receiver, the printer drives the light emitting unit of any ink cartridge adjacent to the to-be-detected ink cartridge to emit light, and detects whether the amount of light received by the light receiver is less than the amount of light received during the facing position light detection. As show in FIG. 3*a*, as for the to-be-detected ink cartridge Y, it will be moved to be in an opposition position to the light receiver so as to control the light emitting unit of the to-be-detected ink cartridge Y to emit light, and the light receiver receives the light to acquire a first light amount S1, and then determine whether the first light amount is greater than a preset threshold value, if yes, then the facing position light detection of the to-be-detected ink cartridge is correct, otherwise, the facing position light detection of the to-be-detected ink cartridge is wrong. As shown in FIG. 3*b,* the position of the to-be-detected ink cartridge Y is maintained unchanged, the light emitting unit of the ink cartridge BK adjacent to the to-be-detected ink cartridge Y is controlled to emit light, and the light receiver receives the light to acquire a second light amount S2, and then determine whether the first light amount is greater than the second light amount, if yes, then the adjacent position light detection of the to-be-detected ink cartridge Y is correct. The position of the ink cartridge is deemed to be correct only if the above two detections are passed. In the above description, a to-be-detected ink cartridge should be comprehended as an ink cartridge which will be subjected to the facing position light detection, and an adjacent ink cartridge should then be comprehended as any ink cartridge adjacent to the to-be-detected ink cartridge.

Moreover, composition of a light emitting control instruction from the imaging device main body will be described hereunder, reference may be made to Table 1 below:

TABLE 1

| Composition of light emitting control instruction | | | | | | | |
|---|---|---|---|---|---|---|---|
| Ink cartridge identification Information | | | | Light control information | | | |
| Ink cartridge BK | 0 | 0 | 0 | 1 | 0 | 0 | ON |
| Ink cartridge C | 1 | 0 | 0 | | | | |
| Ink cartridge M | 0 | 1 | 0 | 0 | 0 | 0 | OFF |
| Ink cartridge Y | 1 | 1 | 0 | | | | |

As shown in Table 1, the light emitting control instruction transmitted by the imaging device main body is mainly composed of two parts: ink cartridge identification information and light control information. The ink cartridge identification information is a code for distinguishing different ink cartridges, in this embodiment, the ink cartridge identification information is "ink cartridge color information", however, other information may also be selected as the ink cartridge identification information, as long as it is capable of playing a role of distinguishing ink cartridges; whereas the light control information is a code for controlling opening and closure of the light emitting unit, that is, an ON/OFF action. As shown in Table 1, 100 indicates the ON action, i.e., driving the light emitting unit to emit light, 000 indicates the OFF action, i.e., extinguishing the light emitting unit, other codes may be used to indicate the two actions, as long as the two actions can be distinguished from each other. In other words, the light control information is also a basis for determining that the light emitting control instruction is a light-on instruction/a light-off instruction. If codes of each of the ink cartridge identification information and each of the light control information are combined in pairs, then a signal for controlling on/off of light emitting units of ink cartridges with different colors may be formed. For instance, 000100 indicates that the light emitting unit of the ink cartridge BK is driven to emit light; and 100000 indicates that the light emitting unit of the ink cartridge C is off.

Embodiment 1

Figure 4:
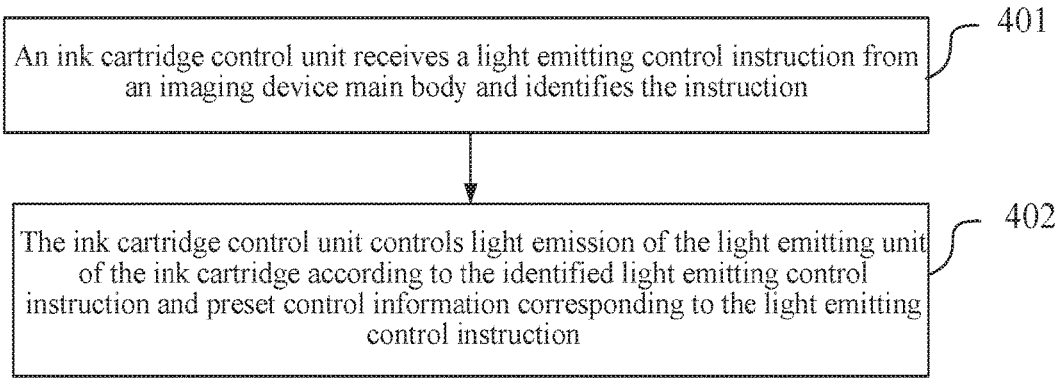
FIG. 4 is a schematic flowchart of a method for controlling light emission of an ink cartridge according to an embodiment of the present invention.

FIG. 4 is a schematic flowchart of a method for controlling light emission of an ink cartridge according to an embodiment of the present invention, and the method is performed by an ink cartridge control unit on the ink cartridge, as show in FIG. 4, including:

401, an ink cartridge control unit, configured to receive and identify a light emitting control instruction from the imaging device main body;

Wherein the light emitting control instruction from the imaging device main body is in the form as shown in Table 1; the ink cartridge control unit is connected to an interface unit of the ink cartridge, and is able to receive from the interface unit the light emitting control instruction from the imaging device main body. The ink cartridge control unit identifies whether the instruction is a light-on instruction or a light-off instruction according to the structure of the light emitting control instruction as shown in Table 1.

402, the ink cartridge control unit, configured to control the light emission of the light emitting unit of the ink cartridge according to the identified light emitting control instruction and preset control information corresponding to the light emitting control instruction;

Wherein the preset control information corresponding to the light emitting control instruction as described in this embodiment refers to control information enabling the light emitting unit in the ink cartridge not to emit light at the adjacent position light detection stage but to emit light at the facing position light detection stage.

For example, the control information may be: if the identified is the light-on instruction, then start light-on delay timing, and when the timing reaches a preset first delay threshold value, control the light emitting unit in emit light; if the identified is the light-off instruction, then start light-off delay timing, and when the timing reaches a preset period of time, control the light emitting unit to be off; the first delay threshold value is less than a first period of time and greater than a second period of time; and the preset period of time is less than a third period of time. The first period of time is a time interval of the facing position light detection stage of the to-be-detected ink cartridge, the second period of time is a time interval of the adjacent position light detection stage of the to-be-detected ink cartridge, and the third period of time is a nine interval between the stages.

For another example, the control information may be: if the identified is the light-on instruction, then only when the number of occurrence of the light-on instruction is 1, control the light emitting unit to emit light; if the identified is the light-off instruction, then control the light emitting unit to be off, and start timing simultaneously; when it is monitored that the timing reaches a preset threshold value, executing the last light emitting control instruction received during the timing process. The preset threshold value is greater than the sum of the second period of time and the third period of time, and less than the sum of the first period of time and the third period of time.

In specific embodiments, light emission of the light emitting unit in the ink cartridge may also be controlled via other forms of control information, as long as the light emitting unit in the ink cartridge is enabled to not emit light at the adjacent position light detection stage but emit light at the facing position light detection stage, thereby ensuring that the amount of light emitted from an adjacent ink cartridge is less than the amount of light emitted from an ink cartridge to be detected, and thus reducing the false report rate in position detection of the ink cartridge.

Several alternative methods for controlling light emission of a light emitting unit in an ink cartridge according to different control information are described hereunder:

Embodiment 2

Figure 5:
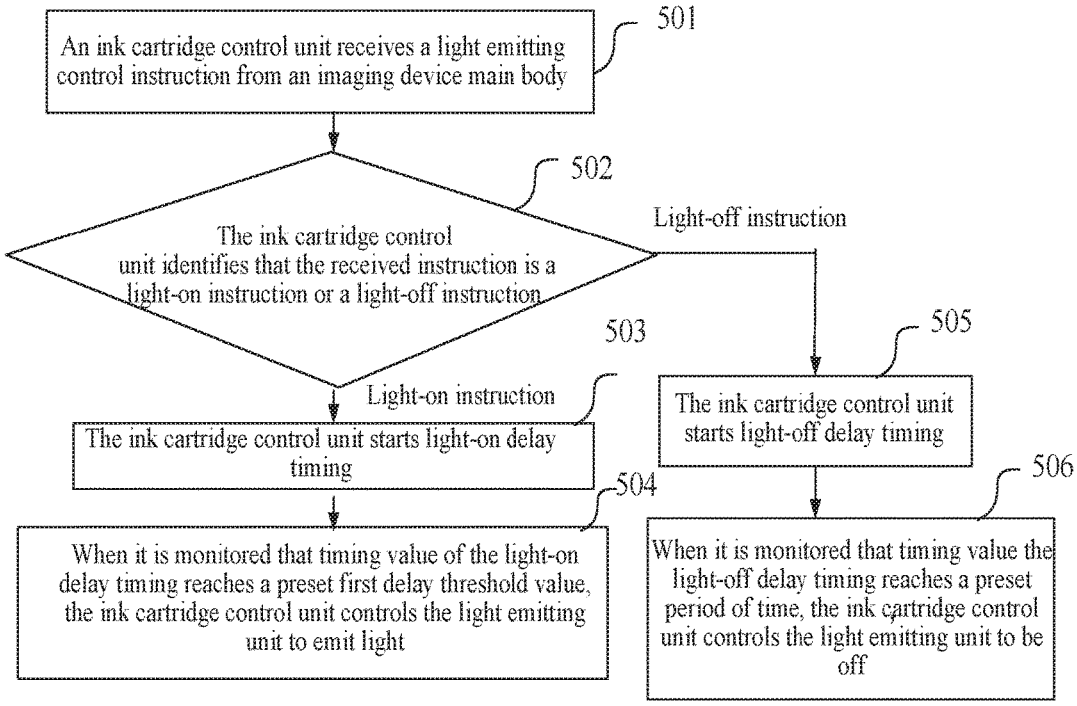
FIG. 5 is a schematic flowchart of a method for controlling light emission of an ink cartridge according to another embodiment of the present invention.

In this embodiment, the ink cartridge control unit specifically is in the manner of delaying both the light-on instruction and the light-off instruction; reference may be made to FIG. 5 for details. FIG. 5 is a schematic flowchart of a method for controlling light emission of an ink cartridge according to another embodiment of the present invention, including:

501, an ink cartridge control unit, configured to receive a light emitting control instruction from the imaging device main body;

502, the ink cartridge control unit, configured to identify the received instruction is a light-on instruction or a light-off instruction;

Wherein the ink cartridge control unit identifies that the instruction is a light-on instruction or a light-off instruction according to the light control information in the light emitting control instruction as described in Table 1.

If the ink cartridge control unit identifies that the light emitting control instruction is the light-on instruction, then continue to proceed with 503-504; and if the ink cartridge control unit identifies that the light emitting control instruction is the light-off instruction, then continue to proceed with 505-506.

503, the ink cartridge control unit, configured to start a light-on delay timing;

When identifying that the light emitting control instruction is the light-on instruction, the ink cartridge control unit will not control the light emitting unit to emit light immediately, but control the light emitting unit to delay emitting light, thereby starting the light-on delay timing.

504, when the ink cartridge control unit monitors that timing value of the light-on delay timing reaches a preset first delay threshold value, it controls the light emitting unit to emit light;

In this embodiment, the light-on delay time that the ink cartridge control unit controls the light emitting unit to delay emitting light is referred to as a first delay threshold value, the first delay threshold value is less than a first period of time and greater than a second period of time. The first period of time is a time interval of the facing position light detection stage of the to-be-detected ink cartridge by the imaging device main body, which may be indicated as T1; the second period of time is a time interval of the adjacent position light detection stage of the to-be-detected ink cartridge by the imaging device main body, which may be indicated as T2. In this embodiment, the first delay threshold value is greater than the second period of time T2, and less than the first period of time T1.

In this embodiment, the first delay threshold value is designed to satisfy the conditions as described above, that is, greater than the second period of time T2 and less than the first period of time T1, such design is based on the following considerations: the first delay threshold value is greater than the second period of time T2, this is equivalent to that, during the time period of the adjacent position light detection, the light emitting unit does not emit light due to delay; meanwhile, the first delay threshold value is less than the first period of time T1, this is equivalent to that, during the time period of the facing position light detection, there is at least light emitting time of a time length of T1-t1 (t1 indicates the first delay threshold value) for detection after a period of delay, and thus it may be ensured that the amount of light during the facing position light detection is inevitably greater than the amount of light during the adjacent position light detection.

Furthermore, after delaying the received light-on instruction for the set first delay threshold value t1, the ink cartridge controls the light emitting unit to emit light, if the light-off instruction is received when the delay time does not reach t1 then directly control the light emitting unit to not emit light, if the light-off instruction is not received when the delay time has reached t1, then control the light emitting unit to emit light.

505, the ink cartridge control unit, configured to start a light-off delay timing;

Wherein the start of light-on delay timing or the light-off delay timing according to this embodiment may be the start for the first time, and may also be restart after reset of a timer which has been started.

506, the ink cartridge control unit, configured to control the emitting unit to be off when it is monitored that timing value of the light-off delay timing reaches a preset period of time;

Wherein the preset period of time is less than a third period of time; the third period of time T3 refers to a time interval between a current light-off instruction and the next light-on instruction, and also is equivalent to a time interval between the facing position light detection stage and the adjacent position light detection stage.

In this embodiment, the ink cartridge delays the received light-off instruction for the preset period of time, and then controls the light emitting unit to stop emitting light, since the preset period of time is less than the third period of time T3, which is equivalent to that after the light-off instruction is received, the light emitting unit is still maintained to emit light for the preset period of time, before the light emitting unit is controlled to stop emitting light. This can ensure that there is a period of time of stopping emitting of T3—the preset period of time, and thereby ensure that light is not emitted at the adjacent position light detection stage. The preset period of time according to this embodiment is a second delay threshold value t2.

Specifically, selection of the preset period of time is related with sensitivity of the light receiver. If the sensitivity of the light receiver is high, then the preset period of time to be selected should be short; and if the sensitivity of the light receiver is low, then the preset period of time to be selected should be long. However, regardless of the selection, it must satisfy the condition of the preset period of time <T3. That is, when the light is off after delaying a certain time, whether the light receiver may identify that the light emitting unit has been off is related with the extent of time reaction of the light receiver receiving a signal; if data transmission is fast, then the reaction is fast and thus the delay time is set shorter; if data transmission is slow, then the reaction is slow and thus the delay time may be set longer relatively.

There may be a plurality of methods for controlling light emission of an ink cartridge. For instance, during the facing position light detection and the adjacent position light detection, a light-on instruction and a light-off instruction are transmitted to a corresponding ink cartridge successively, a light emitting unit of the ink cartridge is controlled to emit light for a certain time, and for each ink cartridge, it is not necessary to distinguish that the light-on instruction and the light-off instruction are used for the facing position light detection or the adjacent position light detection; or, light emitting control instructions of an ink cartridge at the facing position light detection stage and the adjacent position light detection stage may also be combined. In different light emitting control methods, the first period of time, the second period of time and the third period of time are divided in different manners; such as in the following two alternative manners:

An alternative manner is to transmit independently and control a light-on instruction and a light-off instruction in pair at the facing position light detection stage and the adjacent position light detection stage, and control the ink cartridge to move to the facing position during the process of controlling light emission. Then, in this embodiment, the first period of time T1 described above is a time interval between the light-on instruction and the light-off instruction in the facing position light detection of a to-be-detected ink cartridge; the second period of time T2 is a time interval between the light-on instruction and the light-off instruction in the adjacent position light detection of the to-be-detected ink cartridge; and the third period of time T3 is a time interval between the facing position light detection stage and the adjacent position light detection stage, such as a time interval between the light-off instruction at the facing position light detection stage (the adjacent position light detection stage) and the light-on instruction at the adjacent position light detection stage (the facing position light detection stage). Moreover, since the imaging device main body executes independent light emitting control instructions on the to-be-detected ink cartridge during the facing position light detection and the adjacent position light detection, the sequence of the facing position light detection and the adjacent position light detection of each to-be-detected ink cartridge is not limited.

Another alternative manner is that, if an ink cartridge needs to be served as an adjacent ink cartridge of other ink cartridge to emit light, and also needs to serve as a to-be-detected ink cartridge to emit light at the facing position light detection stage, and the two times of light emitting control is consecutive, then merely one group of light-on instruction and light-off instruction may be transmitted to make the ink cartridge emit light all the time, which is equivalent to that the light emitting control instruction of the facing position light detection stage are combined with that of the adjacent position light detection stage. The length of this period of time is at least the sum of a first period of time T1 and a second period of time T2. In this case, the first period of time T1 starts from the light-on instruction and ends when the light receiver receives light of the facing position light detection stage, and the second period of time T2 starts when the light receiver receives light of the adjacent position light detection stage and ends at the light-off instruction. Or, the second period of time T2 starts from the light-on instruction and ends when the light receiver receives light of the facing position light detection, and the first period of time T1 starts when the light receiver receives light of the adjacent position light detection and ends at the light-off instruction. In addition, if light emitting control instructions of the facing position light detection and the adjacent position light detection of the to-be-detected ink cartridge are to be combined, then the solution of this embodiment is applied to a case where the adjacent position light detection is performed before or after the facing position light detection.

In this embodiment, preset light-off delay timing is the second delay threshold value, and further preset period of time is the second delay threshold value.

Furthermore, specific values of the first delay threshold value t1 and the second delay threshold value t2 set for each ink cartridge control unit are preferably set according to the first period of time, the second period of time rang and the third period of time corresponded when the ink cartridge control unit itself servers as a to-be-detected ink cartridge. Moreover, since a plurality of ink cartridges will be mounted to one imaging device, first period of time corresponded when different ink cartridges server as the to-be-detected ink cartridge may he the same or different from each other, the corresponding second period of time may also be the same or different from each other, and the corresponding third period of time may also be the same or different from each other. In the case of being the same, the first delay threshold value set for each ink cartridge control unit is preferably greater than the largest second period of time in the imaging device, and less than the smallest first period of time; whereas the set second delay threshold value is preferably less than the smallest third period of time. In the case of being different, the first delay threshold value set for each ink cartridge control unit only needs to satisfy the rule of "greater than the second period of time and less than the first period of time" as described above, and the second delay threshold value only needs to satisfy the rule of "less than the third period of time". Further, delay threshold values set for different ink cartridge control units may also be the same or different from each other.

Use of the above solution in this embodiment get the results as detected by the light receiver at an imaging device main body side that, within T1 period of time, light is still received to obtain a first light amount, and based on this, the facing position light detection is detected to be correct; within T2 period of time, light will not be received to obtain light amount of zero, which is inevitably less than the first light amount, and based on this, the adjacent position light detection may also be determined to be correct. Thus, it can be seen that the technical solution provided in the embodiment of the present invention not only can satisfy a specific position detection requirement of an imaging device, but also can overcome an false report rate defect caused by manufacturing errors of a light emitting unit in an ink cartridge. Moreover, in the case that an imaging device main body may be in sales and in use, the use of the solution requires no modification to a great number of existing imaging device main bodies, and only needs an improvement to consumable ink cartridges, and thus the solution may be promoted and implemented easily.

In order to describe the method for controlling light emission of an ink cartridge provided in this embodiment more clearly, the above control method will be described hereunder with reference to examples of FIG. 6*a* and FIG. 6*b*.

In this embodiment, four ink cartridges charged with different colors of ink and with the same shape, such as ink cartridge BK, ink cartridge C, ink cartridge M and ink cartridge Y, are mounted to a printer (an imaging device), each ink cartridge is provided with an LED lamp (a light emitting unit), and through observation and measurement of an ink cartridge position detection process in the imaging device main body, movement and detection sequences of ink cartridges during the position detection process are shown as follows:

$$\frac{BK\ \text{ON} - BK\ \text{OFF} - C\ \text{ON}}{BK\ \text{Position}}\ \text{move}$$

$$\frac{C\ \text{OFF} - BK\ \text{ON} - BK\ \text{OFF} - M\ \text{ON}}{C\ \text{Position}}\ \text{move}$$

$$\frac{M\ \text{OFF} - C\ \text{ON} - C\ \text{OFF} - Y\ \text{ON}}{M\ \text{Position}}\ \text{move}$$

$$\frac{Y\ \text{OFF} - M\ \text{ON} - M\ \text{OFF}}{Y\ \text{Position}}$$

Figure 6A:
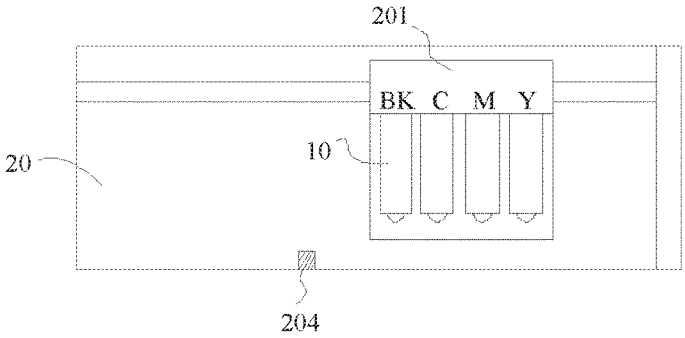
FIG. 6*a* is a schematic diagram of ink cartridges sequence in a method for controlling light emission of an ink cartridge according to still another embodiment of the present invention.

FIG. 6*a* is a schematic diagram of sequences of ink cartridges in a method for controlling light emission of an ink cartridge according to still another embodiment of the present invention, the four ink cartridges are to move by driving of a carriage unit 201; it can be seen in combination with movement sequences of the ink cartridges above that, adjacent position light detection stage of the ink cartridge C where the ink cartridge BK serves as adjacent cartridge and facing position light detection stage of the ink cartridge C where the ink cartridge C itself serves as a to-be-detected ink cartridge are consecutive, and thus in this embodiment, the adjacent position light detection and the facing position light detection are combined to merely include a light-on instruction for once and a light-off instruction for once, that is, C ON and C OFF. Specifically, time intervals between light emitting control instructions transmitted by the printer that are obtained in the facing position light detection and the adjacent position light detection on each ink cartridge and detection types performed by the detection signal are as shown in Table 2. The time interval Δt indicates a time interval between a last instruction and a next instruction, for instance, the time interval between BK ON and BK OFF is 800 ms, the detection type N indicates the adjacent position light detection, P indicates the facing position light detection, and N+P indicates a combination of the adjacent position light detection and the facing position light detection, for instance, at the ink cartridge C.

TABLE 2

Time Interval between Light Emitting Control Instructions and Detection Type Thereof

| Control signal | Time interval Δt | Detection type |
|---|---|---|
| BK ON | 800 ms | P |
| BK OFF | 90.2 ms | |
| C ON | 424 ms | N + P |
| C OFF | 87.8 ms | |
| BK ON | 94.7 ms | N |
| BK OFF | 7 ms | |
| M ON | 398 ms | P |
| M OFF | 78.6 ms | |
| C ON | 94 ms | N |
| C OFF | 8.9 ms | |
| Y ON | 362 ms | P |
| Y OFF | 45 ms | |
| M ON | 87 ms | N |
| M OFF | / | |

For the sake of convenience, a light emitting control instruction transmitted by the printer (the imaging device is directly indicated as "color ID+light emitting control information" hereinafter, for instance, the instruction BK ON indicates that a light emitting unit of the black ink cartridge is driven to emit light, and the instruction BK OFF indicates that the light emitting unit of the black ink cartridge is controlled to be off.

It can be seen from the Δt and the detection type as shown in Table 2 and the detection sequences of the ink cartridges that, when the ink cartridges are subjected to the facing position light detection, the time interval between an instruction for controlling the LED lamp to be on and an instruction for controlling the LED lamp to be off is relatively large, all greater than 300 ms; whereas during the adjacent position light detection, the time interval between a light-on instruction and a light-off instruction is relatively small, basically less than about 100 ms, and time intervals between each light-off instruction and the next light-on instruction are unequal, basically not less than 7 ms. For this reason, in this embodiment, preferably, the first delay threshold value is set to 200 ms, and the second delay threshold value is set to 3 ms, and thus, when a plurality of ink cartridges are subjected to the detection process described above, it can be ensured that the facing position light detection is conducted smoothly, and that the adjacent position light detection is to be avoided, thereby ensuring that even if brightness of the LED lamp (light emitting unit) is weak, an ink cartridge with normal functions may be used normally.

Figure 6B:
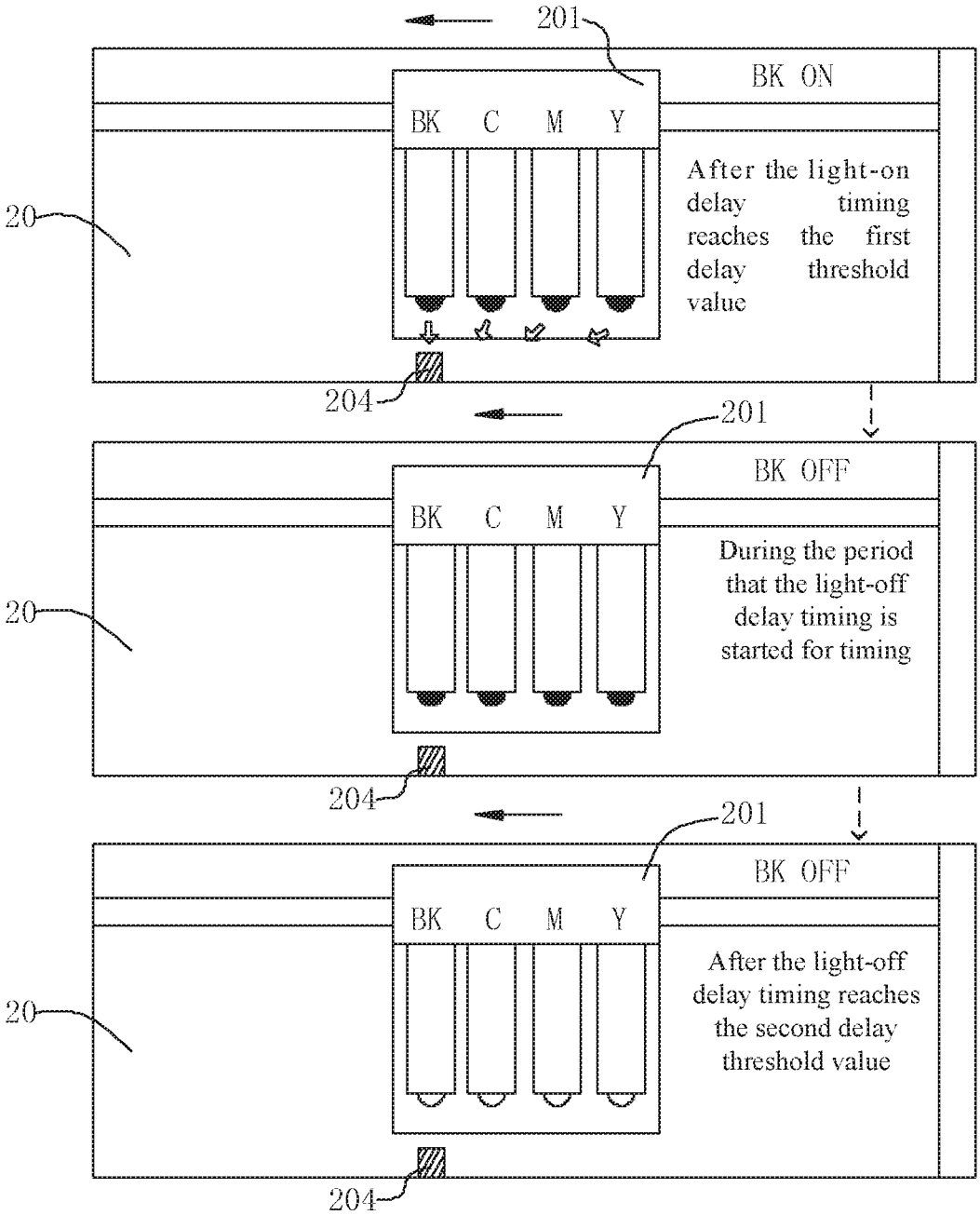
FIG. 6*b* is a schematic diagram of ink cartridge BK position detection in a method for controlling light emission of an ink cartridge according to an embodiment of the present invention.

FIG. 6*b* is a schematic diagram of position detection of ink cartridge BK in a method for controlling light emission of an ink cartridge according to still another embodiment of the present invention. As shown in FIG. 6*b*, when the printer transmits a BK light-on instruction, ink cartridge control units of the four ink cartridges start light-on delay timing when detecting this instruction, until the timing value of the light-on delay timing reaches the first delay threshold value, and then the ink cartridge control units of the four ink cartridges control LED lamps thereon to emit light. After the light emitting units are maintained to emit light for a period of time, the printer transmits a BK light-off instruction, and the ink cartridge control units of the four ink cartridges start light-off delay timing when detecting this instruction, and then the LED lamps of the four ink cartridges still maintain a light emitting status until the timing value of the light-off delay timing reaches the second delay threshold value, and then the ink cartridge control units of the four ink cartridges control the LED lamps thereon to be off. At this time, the facing position light detection stage of the ink cartridge BK has been finished. In such a manner, when the printer transmits control instructions successively as shown in Table 2, each ink cartridge proceed similar to the solution above.

Furthermore, in this embodiment, when the light-on delay timing or the light-off delay timing reaches the first delay threshold value or the second delay threshold value, the light-on delay timing or the light-off delay timing is stopped or reset, and the ink cartridge control units control the light emitting units to be on or off. If the manner of stopping the light-on delay timing is used, then the light-on delay timing or the light-off delay timing is to be started after reset, when the ink cartridge control units receive a light-on instruction or a light-off instruction again. In the course of timing after the light-on delay timing or the light-off delay timing is started, when the ink cartridge control units receive any light emitting control instruction, that is, stopping the light-on delay timing or the light-off delay timing, and after the light-on instruction or the light-off instruction is received again, the light-on delay timing or the light-off delay timing is cleared or reset so as to restart timing; or, the light-on delay timing or the light-off delay timing is directly cleared or reset, so that the light-on delay timing or the light-off delay timing may be started directly for retiming, after the light-on instruction or the light-off instruction is received again.

Embodiment 3

This embodiment differs from Embodiment 2 in that, the preset light-off delay timing according to this embodiment is the second delay threshold value, the preset period of time is less than the second delay threshold value, and less than the third period of time, and the second delay threshold value is greater than the third period of time, and less than the first period of time T1, the ink cartridge control unit may control the light emitting unit to be off automatically after the light-off delay timing starts timing to reach the preset period of time.

Specifically, when the ink cartridge control unit identifies that the light emitting control instruction is a light-off instruction, the light-off delay timing is to be started; when the ink cartridge control unit monitors that the light-off delay timing reaches the preset period of time, the ink cartridge control unit will control the light emitting unit to be off automatically; when the ink cartridge control unit monitors that the light-off delay timing reaches the second delay threshold value, the ink cartridge control unit will control the light emitting unit to stop emitting light. Moreover, in the course of the light-off delay timing, the ink cartridge control unit will not execute the light emitting control instruction received during the timing process, and the light-off delay timing also does not need to be stopped or reset but continue the timing. Remaining steps are the same as in the above embodiment, and will not be described here.

In order to describe a solution for controlling light emission of an ink cartridge provided in this embodiment more clearly, the above control methods will be described hereunder by taking the ink cartridge BK as an example with reference to FIG. 7.

Figure 7:
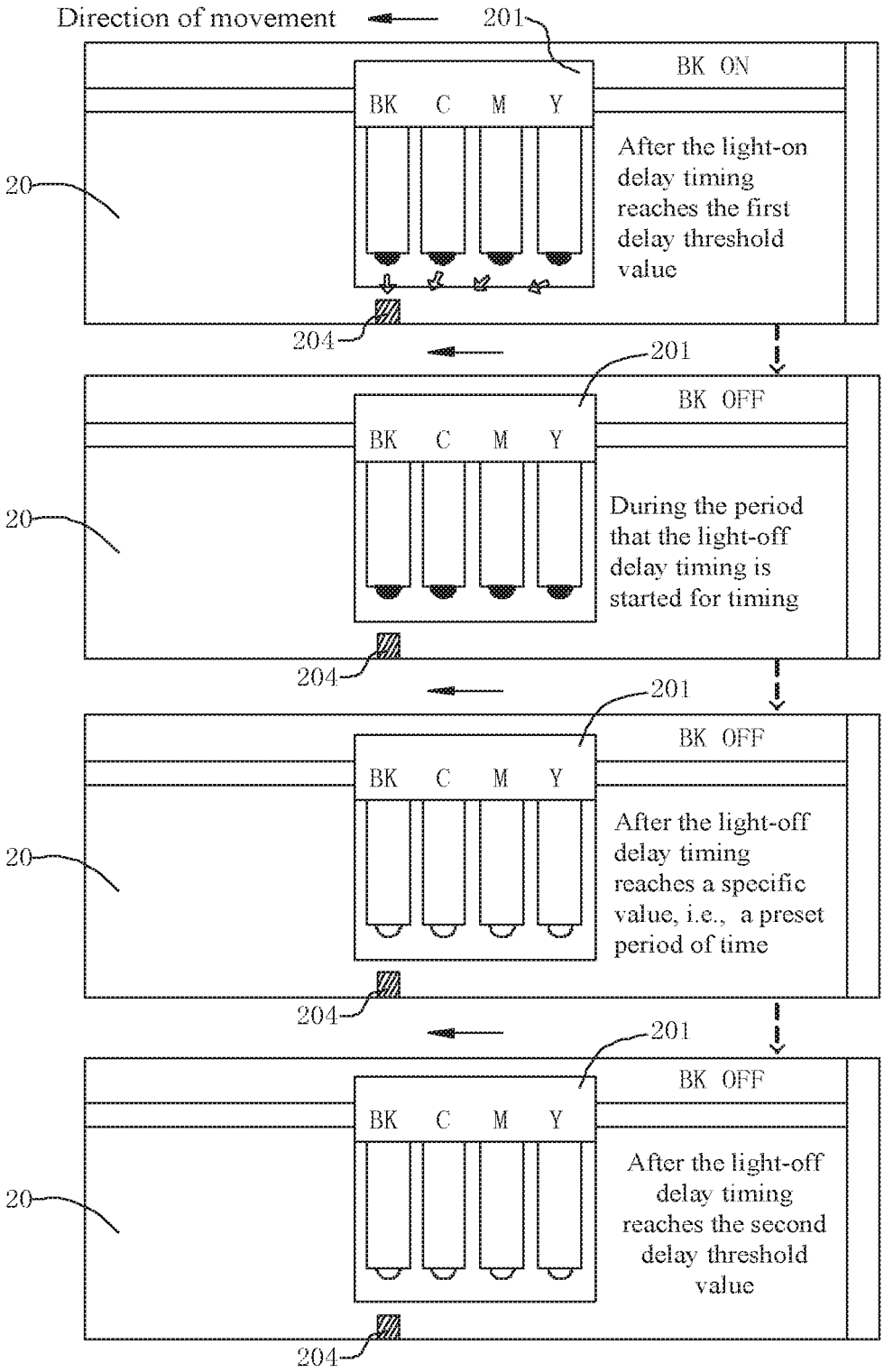
FIG. 7 is a schematic diagram of ink cartridge BK position detection in a method for controlling light emission of an ink cartridge according to still another embodiment of the present invention.

FIG. 7 is a schematic diagram of ink cartridge BK position detection in a method for controlling light emission of an ink cartridge according to an embodiment of the present invention. As shown in FIG. 7, when the printer transmits a BK ON instruction, ink cartridge control units of the four ink cartridges all start light-on delay timing until the light-on delay timing reaches the first delay threshold value, and then the ink cartridge control units of the four ink cartridges will control LED lamps thereon to emit light. After the light emitting units are maintained to emit for a period of time, the printer transmits a BK OFF instruction, and accordingly the ink cartridge control units of the four ink cartridges all start light-off delay timing, but the LED lamps of the four ink cartridges maintain light emitting status until the light-off delay timing reaches a specific value, i.e., the preset period of time, the ink cartridge control units of the four ink cartridges control the LED lamps thereon to be off automatically, and the light-off delay timing is to continue. When the light-off delay timing readies the second delay threshold value, and a new light emitting control instruction has not been received during this period, the ink cartridge control units of the four ink cartridges control the LED lamps thereon to be off again, that is, the four LED lamps all maintain light-off status. At this time, the facing position light detection stage of the ink cartridge BK has been finished. In such a mariner, when the printer sends control instructions successively as shown in Table 2, each ink cartridge proceed similar to the solution above.

Furthermore, with the same as in Embodiment 1, when the light-on delay timing or the light-off delay timing reaches the first delay threshold value or the second delay threshold value, the light-on delay timing or the light-off delay timing is stopped or reset, and the ink cartridge control units control the light emitting units to be on or off. However, in the course of the light-on delay timing or the light-off delay timing, if a new light emitting control instruction is received, the ink cartridge control unit does not execute the new light emitting control instruction and there is no need to stop timing and reset or clear, and the timing is stopped, directly reset or cleared when a preset timing value, such as the first delay threshold value or the second delay threshold value, is reached.

Embodiment 4

Figure 8:
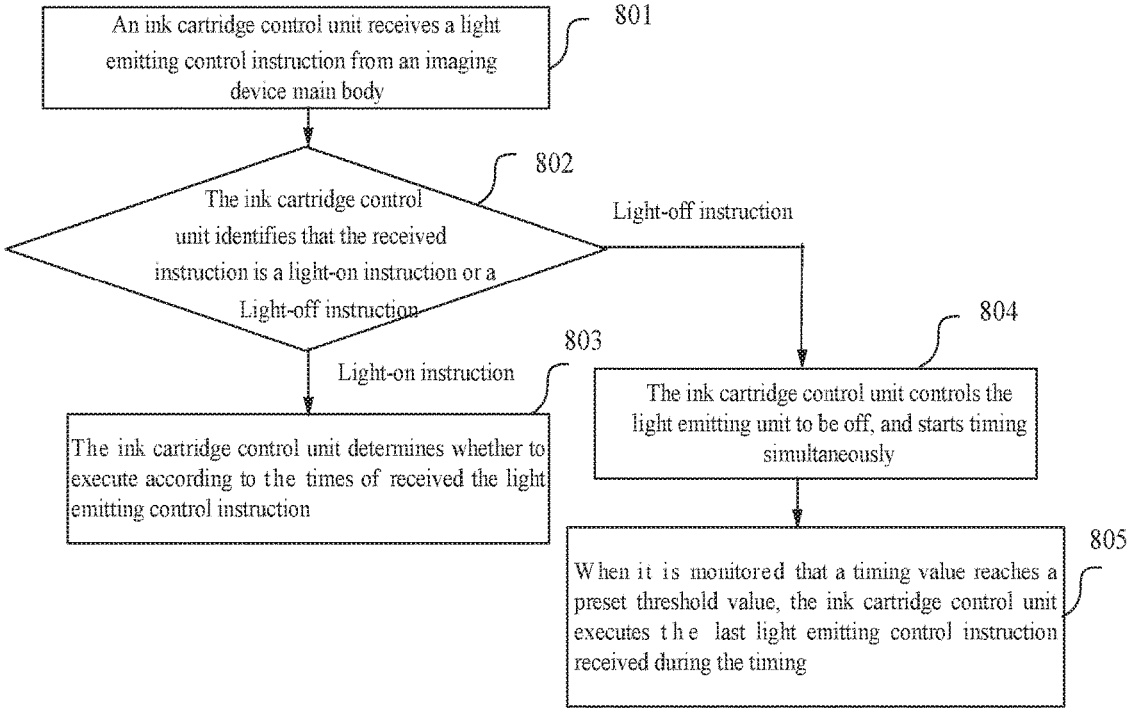
FIG. 8 is schematic flowchart of a method for controlling light emission of an ink cartridge according to still another embodiment of the present invention.

FIG. 8 is schematic flowchart of a method for controlling light emission of an ink cartridge according to still another embodiment of the present invention. The ink cartridge control unit according to this embodiment specifically uses the light-off instruction as a starting point of timing; as shown in FIG. 8, the method may include:

801, an ink cartridge control unit, configured to receive alight emitting control instruction from the imaging device main body;

802, the ink cartridge control unit, configured to identify the received instruction is a light-on instruction or a light-off instruction;

Wherein the ink cartridge control unit identifies that the instruction is a light-on instruction or a light-off instruction according to light control information in the light emitting control instruction;

If the ink cartridge control unit identifies that the light emitting control instruction is a light-on instruction, then proceed with 803; if the ink cartridge control unit identifies that the light emitting control instruction is a light-off instruction, then proceed with 804-805.

803, the ink cartridge control unit, configured to determine whether to execute according to times of the received light emitting control instruction;

If occurrence number of the light-on instruction is 1, then control the light emitting unit to emit light; if occurrence number of the light-on instruction is greater than 1, then do not execute the light-on instruction.

804, the ink cartridge control unit, configured to control the light emitting unit to be off and start timing simultaneously;

805, the ink cartridge control unit, configured to execute the last light emitting control instruction received during the timing, when it is monitored that the timing value reaches a preset threshold value.

Wherein, the preset threshold value is greater than the sum of the second period of time and the third period of time, and less than the sum of the first period of time and the third period of time.

Since a plurality of ink cartridges will be mounted to one printer, the first period of time corresponded when different ink cartridges are used as a to-be-detected ink cartridge may be the same or different from each other, and the corresponding second period of time may also be the same or different from each, and the corresponding third period of time may also be the same or different from each other. In the case of being different, the threshold value set for each ink cartridge control unit is preferably greater than the sum of the largest second period of time and the largest third period of time in the imaging device, and less than the sum of the smallest first period of time and the smallest third period of time. In the case of being the same, the threshold value set for each ink cartridge control unit only needs to satisfy the rule of "greater than the sum of the second period of time and the third period of time, and less than the sum of the first period of time and the third period of time". Furthermore, the threshold values set for different ink cartridge control units may also be the same or different from each other.

It can be seen from the time intervals between control instructions as shown in Table 2 that, the first periods of time of the ink cartridges are different, but all greater than 300 ms, the second periods of time of the ink cartridges are also different, but all less than 100 ms. Moreover, taking an OFF instruction as a node, time intervals between each OFF instruction and the next ON instruction (that is, the third period of time) are also different from each other, roughly between 7 ms-90.2 ms. For the reasons, in this embodiment, according to setting rules of the value as described above, preferably, the preset threshold value t is set to 195 ms.

Furthermore, if the ink cartridge control unit receives a light-off instruction transmitted by the printer, then restart timing after clear or reset; if a light-on instruction transmitted by the printer is received, then neither execute the above instruction nor stop timing.

By using the above technical solutions in this embodiment, it may enable an ink cartridge control unit to perform a delay operation during an adjacent position light detection process, resulting in that the light emitting unit is not controlled to emit light, and thus that the amount of light at the adjacent position light detection stage is 0, which is less than the amount of light at an facing position light detection stage, thereby ensuring that each ink cartridge can pass the position detection process successfully.

FIG. 9*a*-FIG. 9*d* are schematic diagrams of position detection of ink cartridges BK/C/M/Y in a method for controlling light emission of an ink cartridge according to another embodiment of the present invention. The above control method will be described hereunder with reference to FIG. 9*a*-FIG. 9*d*, in which an arrow direction of A as shown in the figures indicates movement direction of the ink cartridges during the detection process (the following description, an ink jet printer is taken as an example of the imaging device).

Figure 9A:
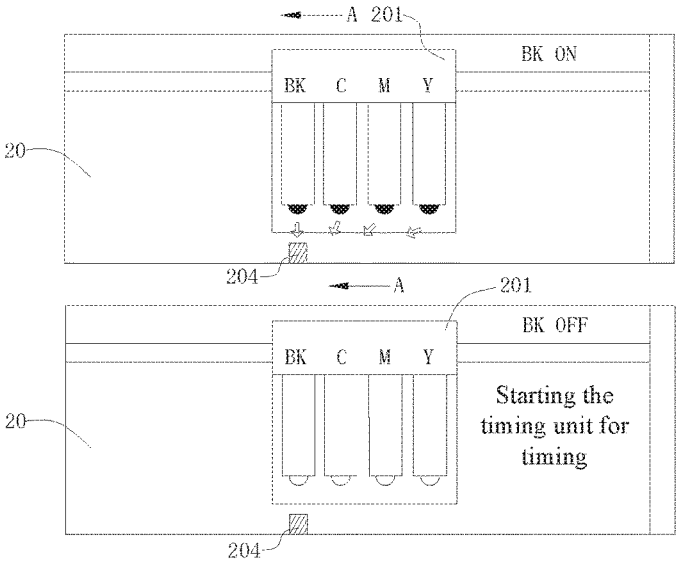
FIG. 9*a*-FIG. 9*d* are schematic diagrams of ink cartridges BK/C/M/Y position detection in a method for controlling light emission of an ink cartridge according to another embodiment of the present invention.

As shown in FIG. 9*a*, when the printer sends a "BK ON" control instruction for the first time, and an ink cartridge control unit receives the BK ON instruction, firstly the instruction is identified as a light-on instruction according to the light control information ON, and since occurrence number of the light-on instruction is 1, at this time the ink cartridge control unit directly executes the BK ON control instruction, that is, ink cartridge control units of the four ink cartridges control LED lamps to emit light. Then, after the LED lamps of the four ink cartridges are maintained to emit light for a period of time, the printer sends a "BK OFF" control instruction, and when the ink cartridge control units receive the instruction, which is determined as a light-off instruction, then the control units of the four ink cartridges extinguish the LED lamps directly, and start timing.

Figure 9B:
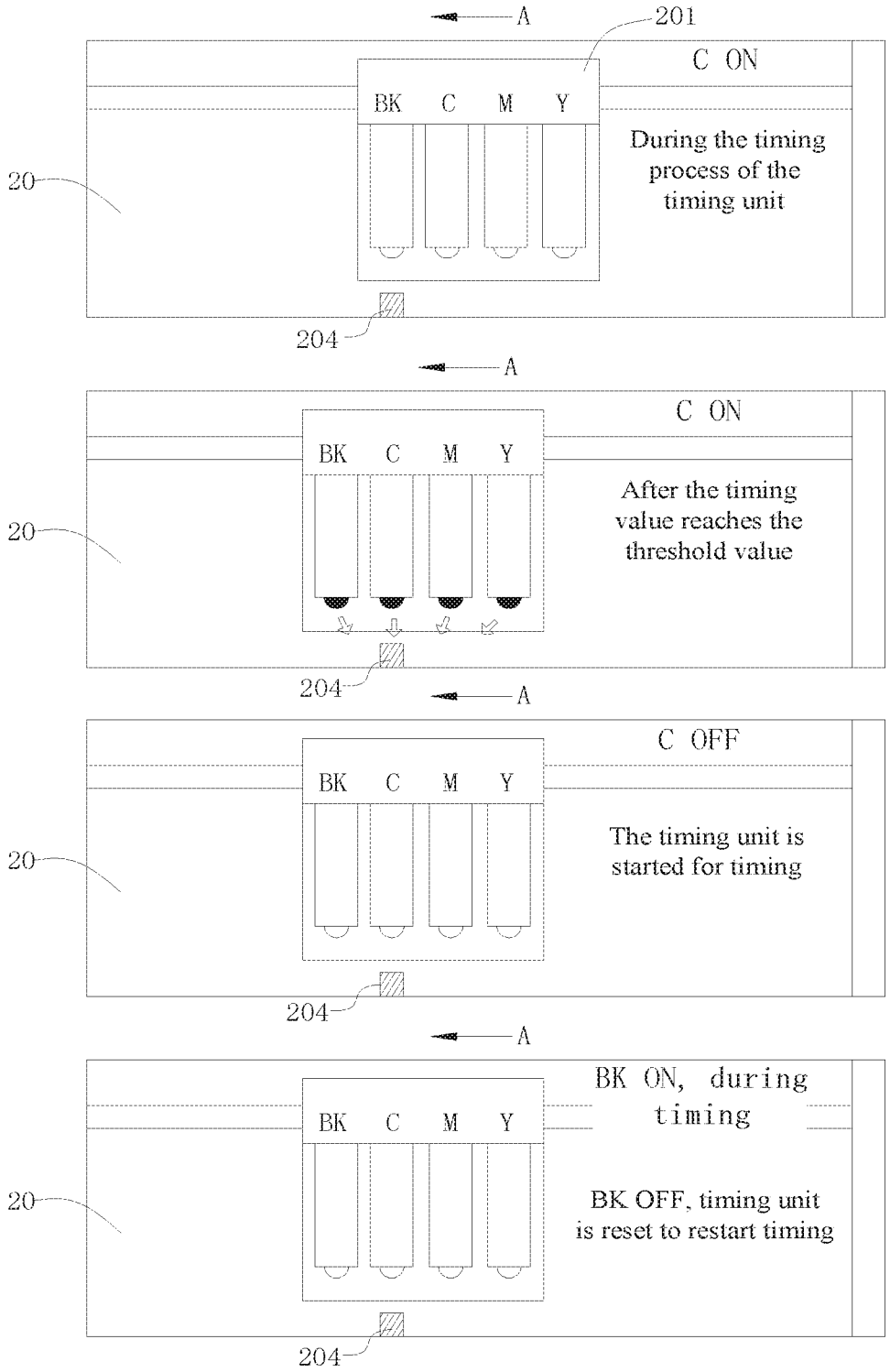

As shown in FIG. 9*b*, as described above, the timing threshold value is 195 ms, and it can be known from Table 2 that, during the timing process, the printer sends a C ON instruction, after receiving the instruction, the ink cartridge control units identify the instruction as a light-on instruction, and count that the light-on instruction has occurred twice, greater than 1, thus the ink cartridge control units do not execute the control instruction and the timing continues. When the ink cartridge control unit monitors that the timing value reaches the preset threshold value, i.e., 195 ms, stop timing, and execute the last control instruction received during the timing period, or execute the last instruction received before reaching the preset threshold value, that is, execute the C ON instruction, then the LED lamp is driven to emit light at this time, which is the facing position light detection of the ink cartridge C. The adjacent position light detection stage of the ink cartridge C where the ink cartridge BK servers as the adjacent cartridge, has been end during the delay period. Similarly, after receiving a C OFF instruction, the ink cartridge control unit controls the LED lamp to be off and starts timing, and moreover, it does not execute the BK ON instruction received during the timing process. When a BK OFF instruction is received, stop timing and clear or reset the timer to restart timing.

Figure 9C:
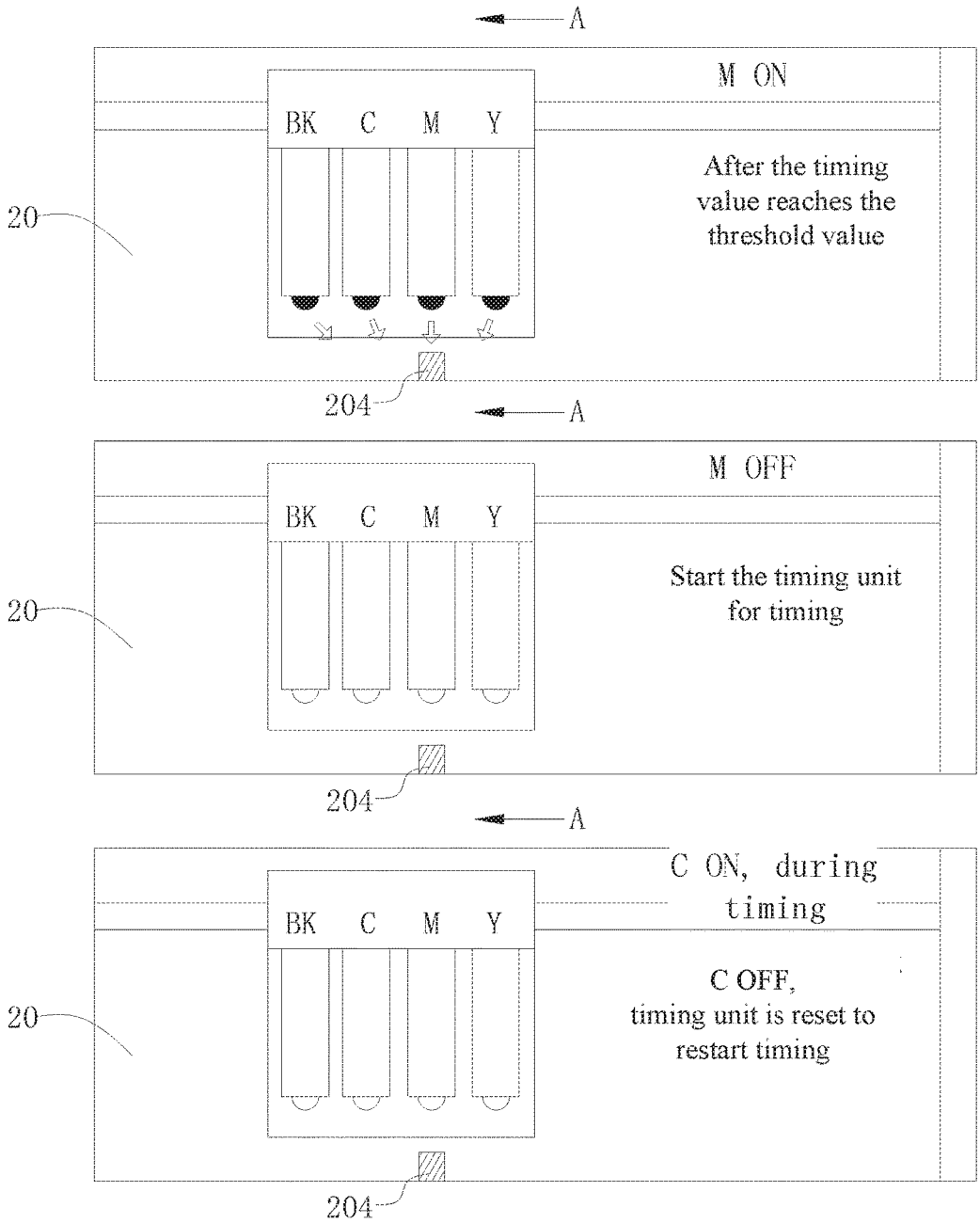
Figure 9D:
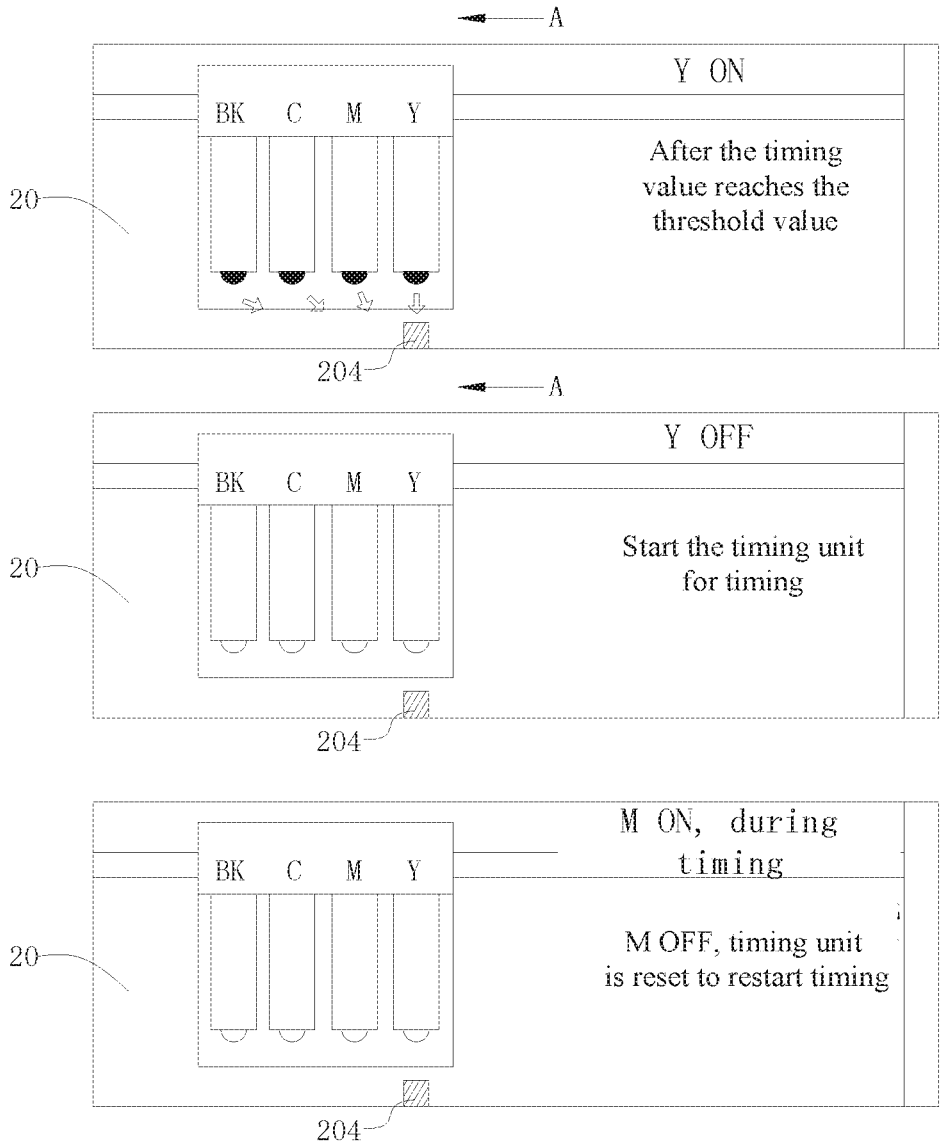

As shown in FIG. 9*c* and FIG. 9*d*, with the same principle as described above, during the timing process after the BK OFF, an M ON instruction received is not executed; when timing value reaches the preset threshold value, the M ON instruction previously received is executed, that is, an LED lamp is driven to emit light. In such a manner, detection methods of the remaining ink cartridges are similar to the description above, and will not be described here.

It can be seen from the above description that, this embodiment treats an "OFF instruction" as a node, the light emitting control instruction at an adjacent position light detection stage is not performed due to the timing operation, so that the light emitting unit at the adjacent position light detection stage does not emit halt, ensuring that the amount of light of the ink cartridge transmitted at an facing position light detection stage is always greater than the amount of light transmitted at the adjacent position light detection stage, and thus ensuring that an ink cartridge position detection process is passed successfully, to avoid a case where "an ink cartridge that is mounted on a correct position is deemed as on a wrong position".

Further description are as follows: since there is deviation on the amount of light of light emitting units in the ink cartridges, which may cause a problem during the position detection process that the detection cannot be passed due to insufficient amount of light of an ink cartridge at the facing position light detection stage, the light emitting units of the ink cartridges are needed to simultaneously emit light or be off at the facing position light detection stage so as to ensure that each ink cartridge can pass the facing position light detection stage successfully (the case where the ink cartridges are on or off simultaneously is also described in the earlier embodiments).

Specifically, the light emitting control instruction of the imaging device main body includes: ink cartridge identification information and light control information; in this embodiment, a light emitting unit of an ink cartridge is controlled to emit light, which may be designed as controlling the light emitting unit of the ink cartridge to emit light or be off according to the light control information only.

In this embodiment, the ink cartridges are connected via a shared line, so any light emitting control instruction transmitted by the imaging device main body can be received by each ink cartridge, when any control instruction is received, each ink cartridge will perform a control on the light emitting unit according to the method for controlling light emission of the ink cartridge as described above, thereby ensuring that a plurality of light emitting units are on or off simultaneously, and thus ensuring that each ink cartridge passes the facing position light detection stage successfully. That is, the ink cartridge control unit according to this embodiment controls the light emitting unit according to the light control information in the light emitting control instruction only, with the ink cartridge identification information in the control instruction being ignored.

Alternatively, during the process where each ink cartridge in this embodiment is subjected to the position detection, at least two ink cartridges are on or off together with the ink cartridge to be detected simultaneously, as long as the ink cartridge to be detected can be ensured to pass at the facing position light detection stage; and in this embodiment, bus connection or single-wire connection can be used between the ink cartridges, and there is no limitation for this.

For instance, as shown in Table 1, the ink cartridge identification information in the light emitting control instruction preferably includes at least two bits of logical values, and thus in this embodiment, light emitting units of at least two ink cartridges are controlled to emit light simultaneously in the following manner: the ink cartridge control unit determines that the above ink cartridge identification information received is ink cartridge identification information of the ink cartridge in which the ink cartridge control unit is located by discarding a part of or all bits of logical values in the above ink cartridge identification information and comparing remaining bits of logical values with corresponding bits of logical values in the ink cartridge identification information of the ink cartridge in which the ink cartridge control unit is located, and as thus it may be ensured that more than two ink cartridges will be illuminated simultaneously. If all bits of logical values are discarded, there will be no remaining bits of logical values, and thus it may be regard that the light emitting control instruction is transmitted to all ink cartridges. In this case, if a plurality of ink cartridge control units use the same first and second delay threshold values, there will be a case where light emitting units of the ink cartridges are illuminated or extinguished simultaneously.

An example is taken as below to illustration: given that the ink cartridge identification information corresponding to each ink cartridge in the imaging device is respectively: BK-000, C-100, M-010, Y-110, if the last two bits of logical values of the ink cartridge identification information on each ink cartridge are discarded, which is equivalent to discarding a part of logical values, the ink cartridge identification information then is changed to BK-0, C-1, M-0, Y-1, and in the case, logical values of remaining bits or corresponding bits of BK and M are the same as those in the light emitting control instruction BK ON, all are 0 (for instance, the first bit "0" of "BK-000" in the BK ON instruction received is the same as that of BK-0, and is also the same as that of M-0), as a result, the ink cartridge identification information in the BK ON instruction is identified as BK-0 and M-0 at this time, and thus the instruction is set to control BK and M, and then the ink cartridges BK and M are illuminated simultaneously, the rest ink cartridges are not illuminated; if all logical values are discarded, which is equivalent to ignoring ink cartridge identification information in the light emitting control instruction, and controlling a light emitting part to emit light according to light emitting control information only.

Furthermore, in this embodiment, an interface unit in the ink cartridge is an electrical contact in contact with printer styluses for exchanging information, thus the logical values described above may be received and transmitted in the form of electrical contact; and preferably, whether or not to discard the logical values may be implemented by means of switching or disconnecting of the electrical contact, for instance, the discarding of the logical value is implemented by disconnection, or, the discarding of the logical value may be preset.

After the timing is started, when the ink cartridge control unit receives a further light emitting control instruction, and the further light emitting control instruction is identified as a light-off instruction, stop the timing, or reset the timing. For instance, if sequence of instructions transmitted by the printer is BK ON/OFF, C ON/OFF, BK ON/OFF, timing is started when the ink cartridge control unit receives a first BK OFF instruction, and then is stopped or reset when the ink cartridge control unit receives a second BK OFF instruction. Then the timing is restarted.

Embodiment 5

Figure 10:
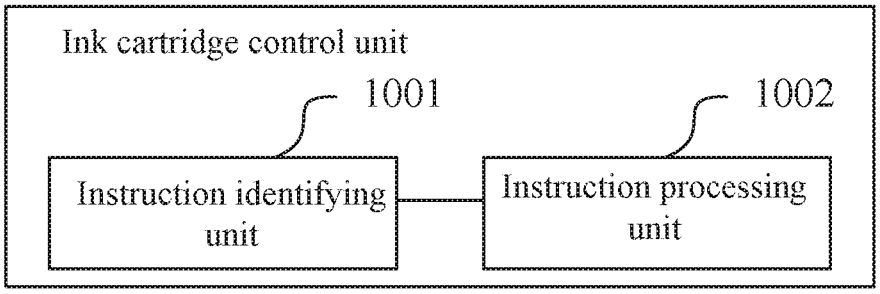
FIG. 10 is a schematic structured diagram of an ink cartridge control unit according to an embodiment of the present invention.

FIG. 10 is a schematic structural diagram of an ink cartridge control unit according to an embodiment of the present invention. Where the ink cartridge control unit is configured to control light emission of the ink cartridge, which may be performed by the method for controlling light emission of the ink cartridge according to any embodiment of the present invention; a structure of the unit is only briefly described in this embodiment, and for specific operating principle thereof, reference may be made to the method embodiments. In specific embodiments, division of unit structures of the ink cartridge control unit is not limited to the description below.

The ink cartridge control unit is configured on an ink cartridge removably mounted to an imaging device main body, and the imaging device main body is configured with an light receiver, the ink cartridge further includes an interface unit for receiving a signal transmitted by the imaging device main body and a storage unit for storing ink cartridge identification information, the ink cartridge control unit is connected to a light emitting unit that emits light towards the light receiver, and is configured to control the light emitting unit to emit light or be extinguished, and the imaging device main body is configured with at least two ink cartridges.

As shown in FIG. 10, the ink cartridge control unit comprises: an instruction identifying unit 1001 and an instruction processing unit 1002, wherein the instruction identifying unit 1001 is configured to receive a light emitting control instruction from the imaging device main body and identify the instruction;

the instruction processing unit 1002 is configured to control the light emission of the light emitting unit of the ink cartridge according to the identified light emitting control instruction and preset control information corresponding to the light emitting control instruction, so that the light emitting unit does not emit light at an adjacent position light detection stage, but emits light at an facing position light detection stage.

Figure 11:
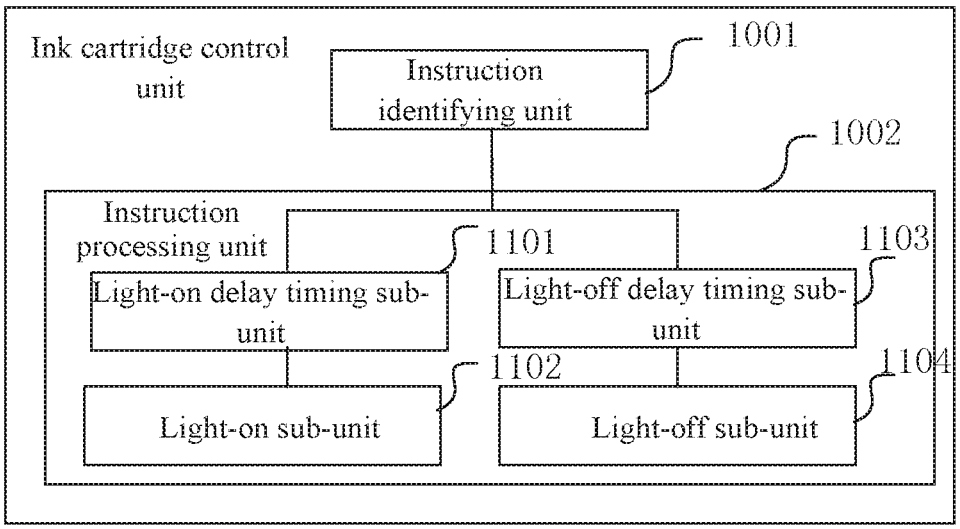
FIG. 11 is a schematic structured diagram of an ink cartridge control unit according to another embodiment of the present invention.

FIG. 11 is a schematic structural diagram of an ink cartridge control unit according to another embodiment of the present invention. The ink cartridge control unit with such structure shows a control mode when both ON and OFF instructions are all delayed, wherein the instruction processing unit 1002 specifically includes: an light-on delay timing sub-unit 1101, a light-on sub-unit 1102, an light-off delay timing sub-unit 1103 and a light-off sub-unit 1104, wherein the light-on delay timing sub-unit 1101 is configured to start light-on delay timing when the instruction identifying unit identifies that the light emitting control instruction is a light-on instruction;

the light-on sub-unit 1102 is configured to control the light emitting unit to emit when the light-on delay timing sub-unit monitors that the light-on delay timing reaches a preset first delay threshold value, where the first delay threshold value is less than a first period of time and greater than a second period of time;

the light-off delay timing sub-unit 1103 is configured to start light-off delay timing when the instruction identifying unit identifies that the light emitting control instruction is a light-off instruction;

the light-off sub-unit 1104 is configured to control the light milling unit to be off when the light-off delay timing sub-unit monitors that the light-off delay timing reaches a preset period of time, where the preset period of time is less than a third period of time; the first period of time is a time interval of the facing position light detection stage, the second period of time is a time interval of the adjacent position light detection stage, and the third period of time is a time interval between the facing position light detection stage and the adjacent position light detection stage.

Figure 12:
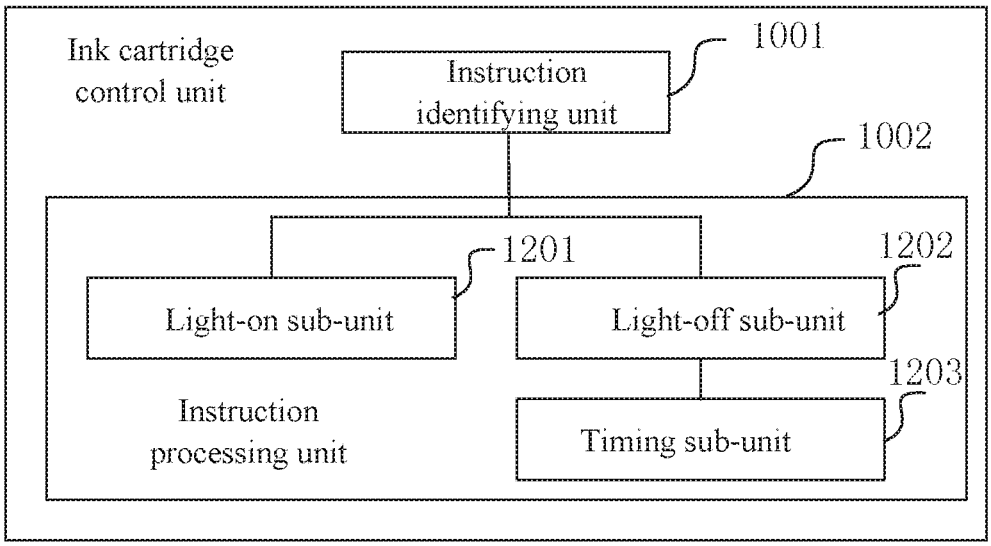
FIG. 12 is a schematic structural diagram of an ink cartridge control unit according to still another embodiment of the present invention.

FIG. 12 is a schematic structural diagram of an ink cartridge control unit according to still another embodiment of the present invention. The ink cartridge control unit with such structure shows a control mode when the light-off instruction is used as a starting point of timing, where the instruction processing unit 1002 specifically includes: a light-on sub-unit 1201, a light-off sub-unit 1202 and a timing sub-unit 1203;

the light-on sub-unit 1201 is configured to control the light emitting unit to emit light when the instruction identifying unit identifies that the light emitting control instruction is a light-on instruction and occurrence number of the light-on instruction is 1; and if occurrence number of the light-on instruction is greater than 1, the light-on sub-unit 1201 do not execute the light-on instruction;

the light-off sub-unit 1202 is configured to control the light emitting unit to be off when the instruction identifying unit identifies that the light emitting control instruction is a light-off instruction;

the timing sub-unit 1203 is configured to start timing at the same time that the light-off sub-unit controls the light emitting unit to be off; and instruct the light-on sub-unit or the light-off sub-unit to execute the last light emitting control instruction received during the timing process when it is monitored that the timing reaches a preset threshold value;

the first period of time is a time interval of the facing position light detection stage, the second period of time is a time interval of the adjacent position light detection stage, and the third period of time is a time interval between the facing position light detection stage and the adjacent position light detection stage; the preset threshold value is greater than the sum of the second period of time and the third period of time, and less than the sum of the first period of time and the third period of time.

Embodiment 6

This embodiment provides an imaging device, including an imaging device main body and at least two ink cartridges, where the imaging device main body includes at least an light receiver, a carriage unit and a position detection module; the at least two ink cartridges are securely mounted to the carriage unit, and the carriage unit is configured to be removable in relative to the light receiver.

Where an interface unit of each of the ink cartridges is connected to an instruction output port of the imaging device main body via a shared line. The position detection module includes: a movement control unit, a light emitting control unit and a light amount detection unit;

The movement control unit is configured to control the carriage unit to move to a position of a to-be-detected ink cartridge facing the light receiver; the light emitting control unit is configured to control alight emitting unit of the ink cartridge to emit light in a first period of time of facing position t detection of the to-be-detected ink cartridge and in a second period of time of adjacent position light detection of the to-be-detected ink cartridge by transmitting a light emitting control instruction to the ink cartridge; the light amount detection unit is configured to determine that the position of the to-be-detected ink cartridge is correct when it is identified that a first light amount received by the light receiver during the first period of time is greater than a first preset light amount, and a second light amount received during the second period of time is less than the first light amount.

Alternatively, the light amount detection unit is specifically configured to determine that the position of the to-be-detected ink cartridge is correct when it is identified that the first light amount received during the first period of time is greater than the first preset light amount, and the second light amount received during the second period of time is less than the first light amount and a second preset light amount.

Alternatively, at least two ink cartridges are included in the imaging device, a first period of time corresponded when each ink cartridge serves as the to-be-detected ink cartridge are different from each other, and the corresponding second period of time and the corresponding third period of time are also different from each other respectively. The first delay threshold value net for the ink cartridge control unit in each ink cartridge is greater than the largest second period of time in the imaging device, and less than the smallest first period of time, and a preset period of time set for each ink cartridge control unit is less than the smallest third period of time.

Alternatively, the first delay threshold values and the preset periods of time set for ink cartridge control units of different ink cartridges are the same or different from each other.

Alternatively, the light emitting unit is placed in a position directly facing to the light receiver;

Or the light emitting unit is placed in a position deviating from the light receiver, an optical guide part is provided between the light emitting unit and the light receiver, and the optical guide part is configured to guide light transmitted by the light emitting unit during light emission to a position facing to the light receiver of each ink cartridge.

Alternatively, the imaging device further includes a rack mounted to the imaging device main body and mounted with the ink cartridge; and At least two of the light emitting units provided on the rack and corresponded to the ink cartridges mounted to the rack one by one.

Specifically, it will be understood by persons of ordinary skill in the art that, the light emitting unit of the ink cartridge in this embodiment may be provided in a position directly facing to the light receiver, or may be provided in a deviated position to use the optical guide part to guide light to the light receiver.

Figure 13:
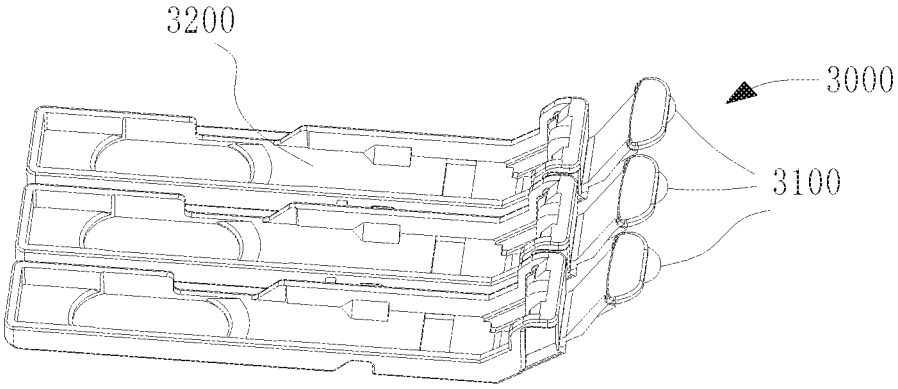
FIG. 13 is a first schematic structural diagram of an imaging device applied in an embodiment of the present invention.

It will be understood by persons of ordinary skill in the art that, in this embodiment, it can be such a manner that one ink cartridge control unit is used to control a plurality of light emitting units. Specifically, FIG. 13 is a first schematic structural diagram of an imaging device applied in an embodiment of the present invention. As shown in FIG. 13, the ink cartridge control unit and a plurality of light emitting units 3100 may be provided on a rack 3000 (where the ink cartridge control unit not shown in the figure may be provided on the rack 3000 or on an ink cartridge, and the ink cartridge control unit is connected to the light emitting units 3100), whereas the rack 3000 is provided between the ink cartridge and the imaging device main body, and is provided with a space 3200 for receiving a plurality of ink cartridges, that is, the rack 3000 is firstly mounted to the imaging device main body, and then is mounted with the ink cartridges, and here, the light emitting units 3100 are corresponding to the mounted ink cartridges one by one. As such, there is no need to provide ink cartridge control units and light emitting units on the ink cartridges, and it only needs to provide a storage unit for storing ink cartridge related information so as to perform data transmission or a read-write operation with the imaging device main body. Moreover, it will be understood by persons of ordinary skill in the art that, in the technical solution above, the plurality of light emitting units may also be provided on the plurality of ink cartridges respectively, and in this way, in order to control the light emitting units according to a light emitting control instruction transmitted by the imaging device main body, it only needs to connect the ink cartridge control units provided on the rack to the plurality of ink cartridges via interface units on the ink cartridges.

Figure 14:
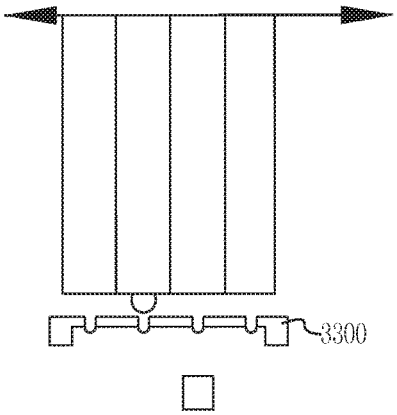
FIG. 14 is a second schematic structural diagram of an imaging device applied in an embodiment of the present invention.

It will be understood by persons of ordinary skill in the art may understand that, in this embodiment, in the ink cartridges mounted to the imaging device main body, only one ink cartridge is provided with ink cartridge control unit and a light emitting unit, and other ink cartridges are not provided with them, and in this case, by providing an optical transmitter 3300, light may be guided to a position facing the light receiver of each ink cartridge, when the light emitting unit emits light, as shown in FIG. 14. FIG. 14 is a second schematic structural diagram of an imaging device applied in an embodiment of the present invention.

Embodiment 7

Figure 15:
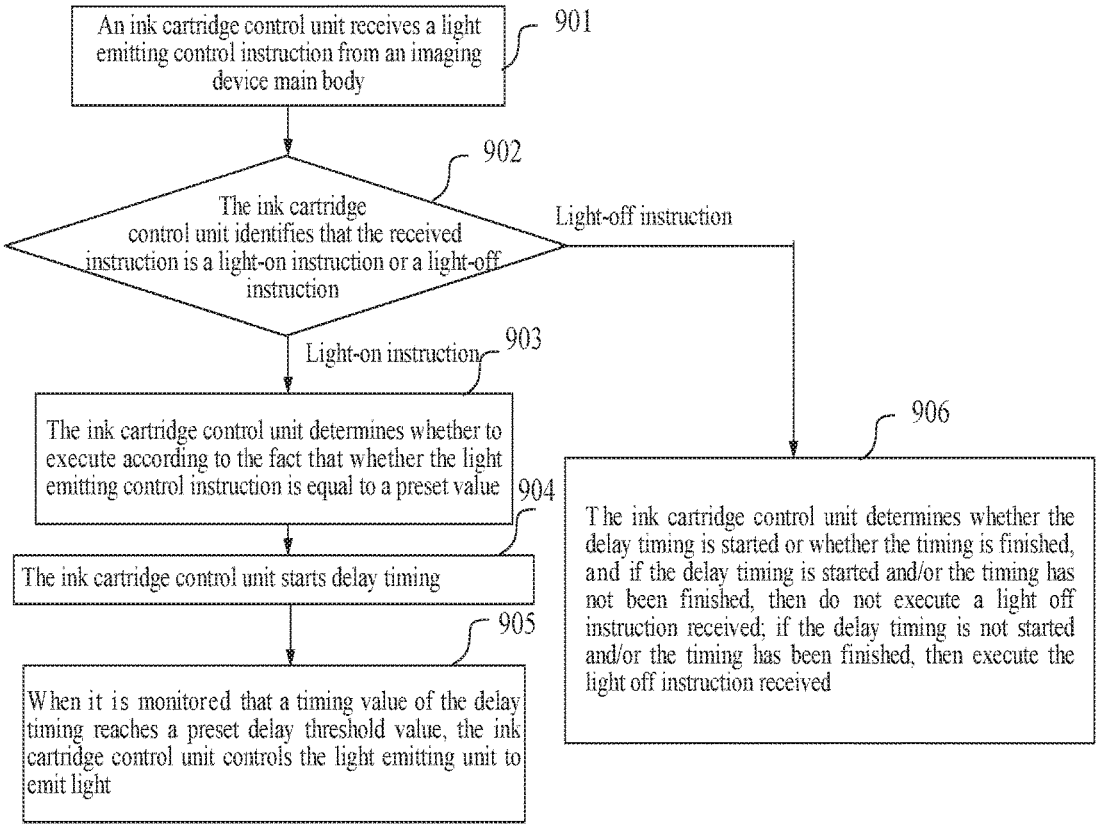
FIG. 15 is a schematic flowchart of a method for controlling light emission of an ink cartridge according to another embodiment of the present invention.

FIG. 15 is a schematic flowchart of a method for controlling light emission of the ink cartridge according to another embodiment of the present invention. The ink cartridge control unit in this embodiment specifically uses a control mode of taking a light-on instruction as a starting point of timing with reference to counting of the light-on instruction. As shown in FIG. 15, the control method may include:

901, an ink cartridge control unit, configured to receive a light emitting control instruction from an imaging device main body;

902, the ink cartridge control unit, configured to identify the received instruction is a light-on instruction or a light-off instruction;

Wherein the ink cartridge control unit identifies that the instruction is a light-on instruction or a light-off instruction according to light control information in the light emitting control instruction.

If the ink cartridge control unit identifies that the light emitting control instruction is the light-on instruction, then continue to proceed with 903; and if the ink cartridge control unit identifies that the light emitting control instruction is the light-off instruction, then continue to proceed with 906.

903, the ink cartridge control unit, configured to determine whether to execute the received instruction according to the fact that the light emitting control instruction is equal to a preset value or not;

If occurrence number of the light-on instruction is accumulated to a preset value, the light-on instruction is not executed; if occurrence number of the light-on instruction is not accumulated to the preset value, it will proceed with 904-905.

904, the ink cartridge control unit, configured to start a delay timing;

When identifying that accumulated number of the light-on instruction is not equal to the preset value, the ink cartridge control unit will not immediately control a light emitting unit to emit light, but control the light emitting unit to delay emitting light, and thus starts the delay timing.

905, the ink cartridge control unit, configured to control the light emitting unit to emit light, when it is monitored that the delay timing reaches a preset delay threshold value; 906, the ink cartridge control unit, configured to determine whether the delay timing is started or whether the timing is finished, if the delay timing has been started and/or the timing has not been finished, then do not execute the received light-off instruction; if the delay timing has not been started and/or the timing has been finished, then execute the received light-off instruction.

In this embodiment, after the timing value of the delay timing reaches the delay threshold value, the ink cartridge control unit controls the light emitting unit to emit light; if a light-off instruction is received when the delay timing has been started and has not reached the preset delay threshold value, then ignore the received light-off instruction, not execute the instruction. If a further light-off instruction is received after the delay time reaches the preset delay threshold value and the light emitting unit is controlled to emit light, then directly execute the received light-off instruction, that is, control the light emitting unit to be off. If a light-on instruction is received when the delay time does not reach the preset delay threshold value, then stop or reset the timing, and delay executing or not execute the light-on instruction according to the control rule described above.

In this embodiment, the delay time that the ink cartridge control unit controls the light emitting unit to delay emitting light is referred to as a delay threshold value, and the delay threshold value is less than a first period of time. The first period of time is a time interval at an facing position light detection stage of a to-be-detected ink cartridge by the imaging device main body.

As described above, it needs facing position detection and relative position detection for each ink cartridge, and during the facing position detection stage and the relative position detection stage, the imaging device main body transmits a light-on instruction and a light-off instruction respectively, and for this reason, when counting light-on instructions received, the ink cartridge control unit may set the preset value as the accumulated number of the light-on instructions corresponded to the adjacent position light detection stage in all light-on instructions received by the ink cartridge control unit.

As shown in Table 3, only a part of light emitting control instructions is taken as an example for describing the setting of the preset value.

For instance, the preset value may be accumulated number of the light-on instruction corresponded that sequentially occur at the adjacent position light detection stage. As shown in Table 3, it can be seen from transmission sequence that, the transmission sequence of BK ON as a light-on instruction at the adjacent position light detection stage of the ink cartridge C is 5, but accumulated number of the light-on instruction corresponded thereto is 3, and in this case, the preset value may be set to 3. When counting that the number of the light-on instructions received is 3, the ink cartridge control unit does not execute the light-on instruction BK ON, and thus the emitting unit at the adjacent position light detection stage is in off status; and when M ON occurs, accumulated number of the light-on instruction corresponded thereto is 4, not 3, then execute the light-on instruction at this time and control the light emitting unit to emit light. As described above, since light emission of the ink cartridge C as an adjacent ink cartridge of the ink cartridge BK and light emission of the ink cartridge C as a to-be-detected ink cartridge during the facing position light detection are a consecutive action, and thus merely a group of light-on instruction and light-off instruction is transmitted at this time, C ON and C OFF includes the adjacent position light detection stage and the facing position light detection stage. If the C ON instruction is not executed directly, it may cause that the light receiver cannot collect sufficient halt amount at the facing position light detection stage of the ink cartridge C, and thus, in this case, it usually adopts a manner of delaying illuminating the light emitting unit.

For this reason, the preset value may be set to accumulated number of the light-on instruction corresponded to the adjacent position light detection stage in which the light emitting unit needs to be prevented, from emitting light in all light-on instructions received by the ink cartridge control unit. Each ink cartridge may include one or more preset values, specific amount and numerical number may be selected according to a particular case or requirement.

TABLE 3

| Accumulated Number of Light Control Instructions | | | | |
|---|---|---|---|---|
| Transmission sequence | Light emitting control instruction | Detection stage | Accumulated number 1 | Accumulated number 2 |
| 1 | BK ON | P | 1 | 1 |
| 2 | BK OFF | | | 2 |
| 3 | C ON | N + P | 2 | 3 |
| 4 | C OFF | | | 4 |

TABLE 3-continued

| Accumulated Number of Light Control Instructions | | | | |
|---|---|---|---|---|
| Transmission sequence | Light emitting control instruction | Detection stage | Accumulated number 1 | Accumulated number 2 |
| 5 | BK ON | N | 3 | 5 |
| 6 | BK OFF | | | 6 |
| 7 | M ON | P | 4 | 7 |
| 8 | M OFF | | | 8 |

It will be understood by persons of ordinary skill in the art that, the preset value may also be set to accumulated number of the light emitting control instruction corresponded to the adjacent position light detection stage in which the light emitting unit needs to be prevented from emitting light in all light emitting control instructions received by the ink cartridge control unit. As shown in Table 3, accumulated number of the light emitting control instruction corresponded to the BK ON instruction of the adjacent position light detection stage of the ink cartridge C is 5, and thus the preset value may be set to 5.

It should be noted that the above description of this embodiment is merely provided for the purpose of illustration, and not intended to limit the scope of the present disclosure. For person having ordinary skill in the art, multiple variations and modifications may be made under the teachings of the present disclosure. For example, the determination in step 903 may be modified to determining whether to execute the received light-on instruction according to the fact that whether the light emitting control instruction does not equal to a preset value. If the occurrence number of the light-on instruction is not accumulated to a preset value, the light-on instruction may not be executed. On the other hand, if the occurrence number of the light-on instruction is accumulated to the preset value, the process may proceed to step 904.

Figure 16:
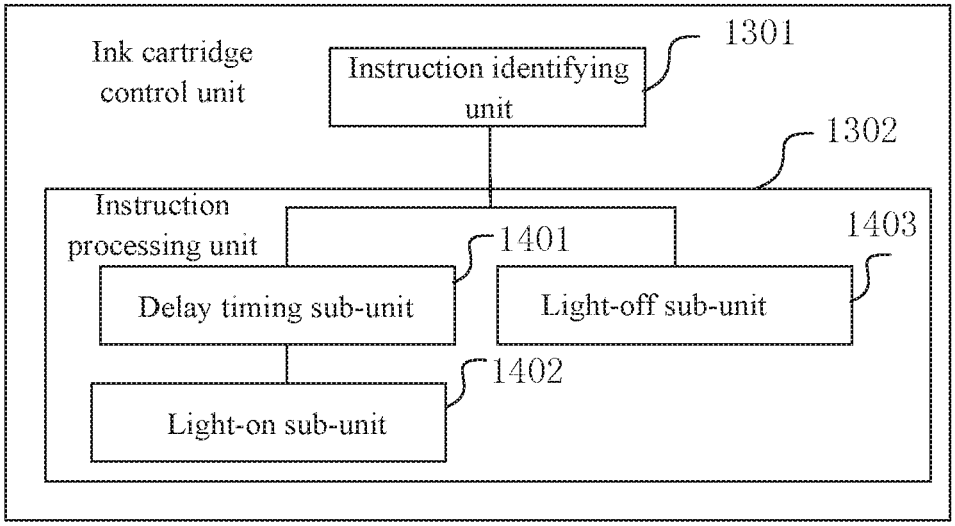
FIG. 16 is a schematic structural diagram of an ink cartridge control unit according to another embodiment of the present invention.

Specifically, FIG. 16 is a schematic structural diagram of a ink cartridge control unit according to another embodiment of the present invention, where the ink cartridge control unit may perform the method for controlling the ink cartridge described above, The ink cartridge control unit comprises: an instruction identifying unit 1301 and an instruction processing unit 1302. The instruction processing unit 1302 specifically includes: a delay timing sub-unit 1401, a light-on sub-unit 1402 and a light-off sub-unit 1403;

the delay timing sub-unit 1401 is configured to start delay timing if the instruction identifying unit 1301 identifies that the light emitting control instruction is a light-on instruction, and accumulated number of the light-on instruction or accumulated number of the light emitting control instruction corresponded when the light-on instruction occurs is not equal to the preset value;

the light-on sub-unit 1402 is configured to control the light emitting unit to emit light when the delay timing sub-unit 1401 monitors that timing value of the delay timing reaches a preset delay threshold value; and not execute the light-on instruction when accumulated number of the light-on instruction or accumulated number of the light emitting control instruction corresponded when the light-on instruction occurs is equal to the preset value;

the light-off sub-unit 1403 is configured to: not execute a light-off instruction when the instruction identifying unit 1301 identifies that the light emitting control instruction is the light-off instruction and the delay timing sub-unit 1401 is still timing at this time; and control the light emitting unit to be of if the delay timing sub-unit 1401 does not start timing or the timing has been finished.

The delay threshold value of the delay timing is less than a first period of time.

Furthermore, the light-on sub-unit 1402 in the ink cartridge control unit is also specifically configured to count light emitting control instructions or light-on instructions transmitted by the imaging device main body to at least two ink cartridges so as to reach the accumulated number.

Furthermore, in this embodiment, the ink cartridge control unit may control the light emitting unit to emit light according to only light control information in the light emitting control instruction, or may utilize the light control information to control the light emitting unit to emit light after selecting corresponding ink cartridge according to ink cartridge identification information in the light emitting control instruction.

Furthermore, a specific value of the delay threshold value set for each ink cartridge control unit is preferably set according to the first period of time corresponded when the ink cartridge control unit itself serves as a to-be-detected ink cartridge. Moreover, since a plurality of ink cartridges will be mounted to one imaging device, then first period of time corresponded when different ink cartridges server as the to-be-detected ink cartridge may be the same or different from each other. In the case of being the same, then the preset threshold value set for each ink cartridge control unit is preferably less than the smallest first period of time in the imaging device. In further, delay threshold values set for different ink cartridge control units may also be the same or different from each other.

The ink cartridge control unit according to this embodiment may also be a unit in a circuit board for controlling light emission of an ink cartridge described above. For instance, the circuit board includes: an interface unit for receiving a signal transmitted by an imaging device main body, a storage unit for storing ink cartridge identification information, and an ink cartridge control unit according to this embodiment. There is also provided an ink cartridge, including an ink cartridge main body and the circuit board for controlling light emission of the ink cartridge described above, where the circuit board is provided with the ink cartridge control unit. Moreover, the preset value may be stored in the storage unit, The storage unit may be provided independently, and may also be integrated in the ink cartridge control unit.

Likewise, the ink cartridge and the imaging device may also include the ink cartridge control unit.

It will be understood by persons of ordinary skill in the art that, "a plurality of ink cartridges are on or off simultaneously", besides using the manner of controlling the light emitting unit according to the light control information in the light emitting control instruction only, may also use a manner of storing ink cartridge identification information of a plurality of ink cartridges in the storage unit of each ink cartridge. As described above, since the ink cartridges are connected by a bus (shared line), alight emitting control instruction transmitted by the ink jet printer each time will be received by a control unit of each ink cartridge, then the control unit acquires the ink cartridge identification information and the light control information in the light emitting control instruction and then compares the ink cartridge identification information of the light emitting control instruction with a plurality of ink cartridge identification information prestored in the storage unit, and if the plurality of ink cartridge identification information include the ink cartridge identification information in the light emitting control instruction, then the control unit of each ink cartridge will control each light emitting unit to be on or off according to the light control information.

It will be understood by persons of ordinary skill in the art that, in the embodiments above, the ink cartridge control unit not only can use a manner of controlling a plurality of ink cartridges to be on or off simultaneously, but also can use a manner of controlling a particularly selected ink cartridge to emit light by the light emitting unit thereof after receiving a light emitting control instruction each time. Specifically, the ink cartridge control unit acquires the ink cartridge identification information and the light control information in the light emitting control instruction, and compares the ink cartridge identification information therein with the ink cartridge identification information prestored in the storage unit, and if they are consistent, then control the light emitting unit of the ink cartridge to be on or off, and if they are inconsistent, then do not execute the light emitting control instruction; as such, the ink cartridges may be controlled to be on sequentially.

In addition, an false report of ink cartridge position detection may also be resulted from other reasons. During controlling light emission for position detection of an ink cartridge, a control method of "bus control and ID matching" is usually used, that is, a plurality of ink cartridges in the imaging device main body are connected by a shared line and are connected to the same bus, a control instruction transmitted by a printer for controlling light emission of an ink cartridge light source will be transmitted in the bus, and received by all ink cartridges connected to the bus, the control instruction is carried with the ink cartridge identification information of the ink cartridge to be controlled; however, only the ink cartridge in which the ink cartridge identification information stored is the same as the ink cartridge identification information carried in the control instruction i.e., to-be-detected ink cartridge, will control a light source to be on or off according to the control instruction, and other ink cartridges will not control light emission of the light source according to the control instruction since the ink cartridge identification information stored therein is different from the ink cartridge identification information carried in the control instruction. However, when driving a light emitting unit of an ink cartridge to emit light, the printer will consume a large voltage, and generate interfering circuit noise in the bus of signal transmission, for instance, when a light emitting unit of the black ink cartridge is driven to emit light, there will be interference in a transmission line from the printer to the black ink cartridge; such interference will affect reception of other signals, because as described above, the ink cartridges are connected in a shared line, and the interference exists on the bus, so other signals that need to be transmitted on the bus such as a signal controlling the yellow ink cartridge to be on or off, will be affected by the interference, and there may be a case where the yellow ink cartridge cannot receive the signal, so that the yellow ink cartridge cannot receive and execute the control instruction correctly, and cannot emit light or be extinguished correctly, thereby causing the false report of ink cartridge position detection.

In order to reduce the false report rate during the ink cartridge position detection, embodiments of the present invention also provide a further ink cartridge control unit, circuit board, ink cartridge and imaging device. The further ink cartridge control unit, circuit board, ink cartridge and imaging device are described hereunder by taking the ink jet printer as shown in FIG. 1*a*-FIG. 2*b* and the ink cartridge position detection principle as shown in FIG. 3*a*-3*b* as an example.

Embodiment 8

Figure 17:
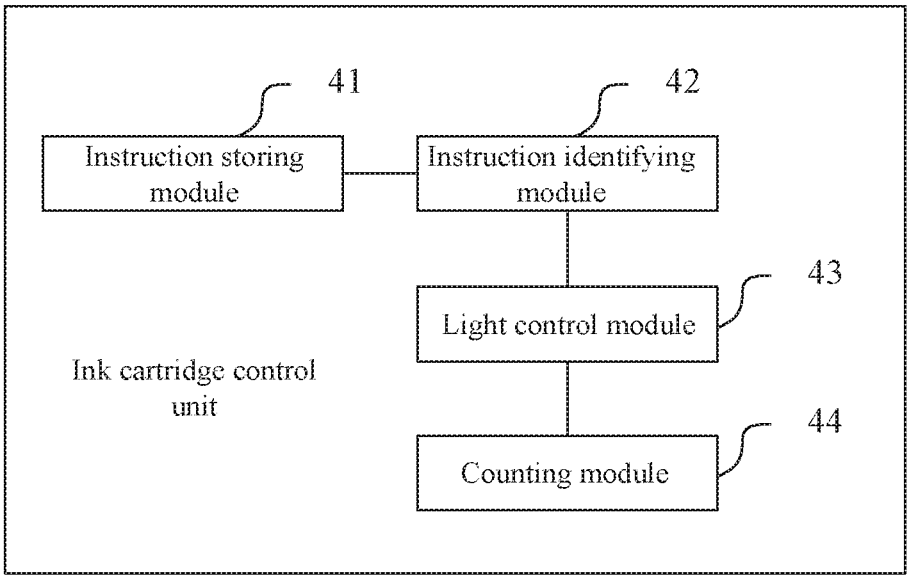
FIG. 17 is a schematic structural diagram of an ink cartridge control unit according to the present invention.

This embodiment provides an ink cartridge control unit, FIG. 17 is a schematic structural diagram of the ink cartridge control unit according to an embodiment of the present invention. As shown in FIG. 17, the ink cartridge control unit may include: an instruction storing module 41, an instruction identifying module 42, a light control module 43 and a counting module 44; wherein the instruction storing module 41 is configured to store light emitting control instructions transmitted by the imaging device main body to at least two of the ink cartridges, and the light emitting control instructions are arranged in a sequence in which the imaging device main body transmits them, the light emitting control instructions include light control information and ink cartridge identification information, and the instruction storing module 41 is also stored with instruction identification information corresponded by the light emitting control instructions with the above sequence;

where the light emitting control instructions transmitted by the imaging device main body to at least two of the ink cartridges refers to, for instance, that the imaging device main body is provided with at least two of the ink cartridges including the ink cartridge BK, the ink cartridge Y, the ink cartridge C and the ink cartridge M, and the light emitting control instructions is transmitted to these ink cartridges, as shown in Table 4:

TABLE 4

Light Emitting Control Instructions and Detection Types Arranged According to Transmission Sequence Number

| Transmission sequence number | Light emitting control instruction | Detection type |
|---|---|---|
| 1 | BK ON | P |
| 2 | BK OFF | |
| 3 | C ON | N + P |
| 4 | C OFF | |
| 5 | BK ON | N |
| 6 | BK OFF | |
| 7 | M ON | P |
| 8 | M OFF | |
| 9 | C ON | N |
| 10 | C OFF | |
| 11 | Y ON | P |
| 12 | Y OFF | |
| 13 | M ON | N |
| 14 | M OFF | |

As above, Table 4 is a schematic diagram of sequence of light emitting control instructions transmitted by the imaging device main body and detection types of the detection signals when the ink cartridges are subjected to facing position light detection and adjacent position light detection, wherein the detection type N indicates the adjacent position light detection, P indicates the facing position light detection, and N+P then indicates a combination of the adjacent position light detection and the facing position light detection, for instance, at the ink cartridge C (here, since two stages where the ink cartridge C is used to adjacent position light detection of the ink cartridge BK and facing position light detection itself are consecutive, the two stages are combined here to merely transmit a light-on instruction for once and a light-off instruction for once). The light emitting control instructions are arranged in a sequence the imaging device main body transmits them, that is, arranged according to the transmission sequence number as shown in Table 4.

Moreover, the instruction storing module 41 according to this embodiment is also stored with instruction identification information corresponded by the light emitting control instructions with the sequence described above; reference may be made to Table 5 as below:

TABLE 5

Instruction Identification Information of Light Emitting Control Instructions Arranged According to Transmission Sequence Number

| Transmission sequence number | Light emitting control instruction | Instruction identification information 1 (time interval value) | Instruction identification information 2 (accumulated number) |
|---|---|---|---|
| 1 | BK ON | 0 ms | 1 |
| 2 | BK OFF | 800 ms | 2 |
| 3 | C ON | 90.2 ms | 3 |
| 4 | C OFF | 424 ms | 4 |
| 5 | BK ON | 87.8 ms | 5 |
| 6 | BK OFF | 94.7 ms | 6 |
| 7 | M ON | 7 ms | 7 |
| 8 | M OFF | 398 ms | 8 |

As show in Table 5 above, only a part of light emitting control instructions is taken as an example for describing instruction identification information. The instruction identification information may be conceived as identifying the instruction, as long as the instruction identification information is obtained, a corresponding light emitting control instruction is obtained.

For example, the instruction identification information may be a time interval value between two instructions, and BK ON and BK OFF corresponding to sequence number 1 and 2 are corresponding to time interval values of 0 ms and 800 ms respectively, which refers to that, if BK ON is taken as a starting point of timing, then the time corresponding to BK ON is 0 ms, which is equivalent to the starting point of timing, and after 800 ms, BK OFF is initiated, as long as a time point with an interval of 800 ms to the BK ON is obtained, the instruction corresponded to this time point is BK OFF, which thus equivalents to that the time point of 800 ms is corresponding to BK OFF, and 800 ms is instruction identification information of BK OFF. Likewise, if BK OFF is taken as a starting point of timing, then the instruction corresponding to a time point with an interval of 90.2 ms to BK OFF is C ON, which equivalents to that a timepoint of C ON is 90.2 ms after BK OFF as the starting point of timing, and 90.2 ms is instruction identification information of C ON. Alternatively, the time interval value may also be a time interval between any light emitting control instruction arranged according to a sequence number in which the first light emitting control instruction is taken as a starting point of timing and the first light emitting control instruction; for instance, a time interval value between C ON and BK ON is: 800+90.2=890.2 ms, that is, if BK ON is taken as a starting point of timing, then the time point corresponding to 890.2 ms is C ON, 890.2 ms is instruction identification information of C ON. It can be seen from the above description that, for the manner of taking a time interval value as instruction identification information, specific values of the instruction identification information are associated with the starting point of timing.

For another example, the instruction identification information may also be accumulated number corresponded when each light emitting control instruction occurs according to a sequence number. For instance, according to the transmission sequence number, C ON ranks the third place, thus accumulated number corresponded thereto is 3; M ON ranks the seventh place, thus accumulated number corresponded thereto is 7. Alternatively, the accumulated number may also be accumulated number corresponded when each light emitting control instruction is arranged according to sequence of appearance in a type of control instructions to which the light emitting control instruction belongs. The type of control instructions refers to an ON control instruction or an OFF control instruction; for instance, C ON ranks the second place in the ON control instruction, then accumulated number corresponded thereto is 2; M OFF ranks the fourth place in the OFF control instruction, then accumulated number corresponded thereto is 4.

A light emitting control instruction stored in the instruction storing module 41 according to this embodiment includes light control information and ink cartridge identification information; wherein an ink cartridge control unit may determine Whether the light emitting control instruction needs to be executed according to the ink cartridge identification information. For instance, in the case of the ink cartridge identification information, when the ink cartridge identification information in the light emitting control instruction stored in the instruction storing module 41 is the same as the ink cartridge identification information of the ink cartridge itself, it is determined that the light emitting control instruction needs to be executed. In addition, the instruction storing module 41 may also be stored with an execution identifier, which is preset indication information for indicating whether the light emitting control instruction needs to be executed, and for instance, can use bits 0 and 1 for indication, where 0 indicates that no execution is needed, and 1 indicates that an execution is needed. Reference may be made to Table 1 for the structure of the light emitting control instruction, and the structure is also composition of a common light emitting control instruction.

As shown in Table 1, the light emitting control instruction transmitted by the ink jet printer is mainly composed of two parts: ink cartridge identification information and light control information. The ink cartridge identification information is a code used for distinguish different ink cartridges by the printer. In this embodiment, "ink cartridge color information" is used as the ink cartridge identification information. However, other information may also be selected as the ink cartridge identification information, as long as they can play a role of distinguishing ink cartridges. Whereas the light control information is a code used for controlling opening and closure of the light emitting unit, that is, an ON/OFF action. As shown in Table 1. 100 indicates the ON action, i.e., driving the light emitting unit to emit light, 000 indicates the OFF action, i.e., extinguish the light emitting unit, and other codes may be used to indicate the two actions, as long as they can play a role of distinguishing the two actions. Or say, the light control information is also used as a basis for distinguishing that the light emitting control instruction is a light-on instruction/a light-off instruction. If codes of individual ink cartridge identification information and individual light control information are combined in pairs, then a light emitting control instruction for controlling on/off of light emitting units of ink cartridges with different colors may be formed. For instance, 000100 indicates that the light emitting unit of the ink cartridge BK is driven to emit light; and 100000 indicates that the light emitting unit of the ink cartridge C is extinguished.

The instruction identifying module 42, which is connected to the instruction storing module and an interface unit in an ink cartridge respectively, is configured to receive from the interface unit a light emitting control instruction from the imaging device main body, and determine whether the first light emitting control instruction received is the same as the first light emitting control instruction stored in the instruction storing module and arranged according to the sequence;

Wherein after receiving the first light emitting control instruction transmitted by the imaging device main body, the interface unit in the ink cartridge such as the ink cartridge side electrical contacts 302 as shown in FIG. 2*a* will transmit the instruction to the instruction identifying module 42 in the ink cartridge control unit according to this embodiment. The instruction identifying module 42 will determine whether light control information and ink cartridge identification information in the first light emitting control instruction are the same as the light control information and the ink cartridge identification information in the first light emitting control instruction stored in the instruction storing module and arranged according to the sequence. For instance, assuming that the first light emitting control instruction received is BK ON; refer to Table 4, the first light emitting control instruction stored in the instruction storing module 41 is also BK ON, and then the results are determined to be the same. That is, the instruction identifying module 42 is actually to determine whether the two light emitting control instructions are the same. In the case of being the same, instruct a light control module 43 described as below to process, otherwise, neither execute nor process the instruction.

The light control module 43, which is connected to the instruction identifying module, the instruction storing module and the counting module respectively, is configured to instruct the counting module to start counting when results determined by the instruction identifying module are the same; and control the light emitting unit to be on or off according to the light control information included in the light emitting control instruction when it is determined that the counting module obtains the instruction identification information by counting and that the light emitting control instruction needs to be executed;

The counting module 44 is configured to count instruction identification information and transmit the instruction identification information to the light control module.

The counting of the instruction identification information performed by the counting module 44 corresponds to a time interval value of counting by timing, or accumulated number of counting. For instance, the counting module 44 obtains by timing a time point with an interval of 800 ms to the first light emitting control instruction (such as BK ON) executed, that is, the instruction identification information obtained is 800 ms, as shown in Table 4, 800 ms is actually a time interval value between BK ON and BK OFF, thus the light emitting control instruction corresponding to the instruction identification information 800 ms is actually BK OFF. After the counting module 44 transmits the instruction identification information 800 ms obtained through counting to the light control module 43, the light control module 43 can get that the light emitting control instruction corresponding to the instruction identification information is BK OFF.

The light control module 43 can also determine whether the instruction needs to he executed according to ink cartridge identification information in the light emitting control instruction or an execution identifier stored in the instruction storing module, that is, whether it needs to control the light emitting unit to be on or off according to light control information in the instruction; where the execution identifier may be indicated by the way of preset indication information.

For instance, if it is determined according to the ink cartridge identification information whether the instruction is to be executed, composition of the light emitting control instruction has the structure as shown in Table 4, including light control information and ink cartridge identification information. After obtaining a corresponding light emitting control instruction according to the instruction identification information, the light control module 43 will further compare whether the ink cartridge identification information in the light emitting control instruction is the ink cartridge identification information of an ink cartridge to which the ink cartridge control unit belongs, specifically, may compare with ink cartridge identification information stored in a storage unit of the ink cartridge, and when a comparative result shows that both of them are the same, it indicates that the instruction needs to be executed, then the light emitting unit is controlled according to the light control information in the instruction.

For instance, if it is determined according to the execution identifier whether the instruction is to be executed, then after obtaining a corresponding light emitting control instruction according to the instruction identification information, the light control module 43 further needs to determine whether to execute the light emitting control instruction according to preset indication information such as 0 or 1.

It can be seen from the description above that, as long as the ink cartridge control unit receives a first instruction which is the same as the instruction stored, the ink cartridge control unit can start counting instruction identification information by itself, identify a corresponding light emitting control instruction automatically according to the instruction identification information obtained through counting, and can also determine whether the instruction needs to be executed, thereby realizing automatic identification of the light emitting control instruction and execution of the determining process, and no longer depending on an instruction transmitted by the imaging device main body, and even though an ink cartridge cannot receive the instruction correctly due to influence of circuit noise, an ink cartridge control unit in the ink cartridge can also automatically implement correct execution of the instruction according to the method described above, thereby ensuring normal light emission of the ink cartridge light emitting unit, and thus reducing the false report rate of ink cartridge position detection.

It should be noted that, in a specific embodiment, the structure of the ink cartridge control unit may be changed flexibly, for instance, information stored in the instruction storing module and processing of other modules may be different; several alternative ways are described as below:

An alternative way is that, an imaging device main body is provided with a plurality of ink cartridges, each ink cartridge is provided with the ink cartridge control unit, and light emitting control instructions stored in each ink cartridge and transmitted by the imaging device main body to at least two of the ink cartridges may be different. For instance, instructions stored in the ink cartridge BK may be all instructions as shown in Table 1; and instructions stored in the ink cartridge C may be all instructions starting from the instruction C ON corresponding to the transmission sequence number 3 as shown in Table 1, that is, instructions from the sequence number 3 to the sequence number 14, only that the sequence number 3 needs to be changed as sequence number 1 because the instruction C ON has ranked the first place in the ink cartridge C.

Correspondingly, in this way, when it is to determine whether the first light emitting control instruction received is the same as the first light emitting control instruction arranged according to the sequence, it is actually to find an instruction corresponding to the sequence number 1 described above, and start counting from the instruction. For instance, an instruction corresponding to the sequence number 1 of the ink cartridge BK is BK ON, and when an instruction transmitted by the imaging device main body is received, it not only needs to determine whether light control information included in the instruction is ON, but also needs to determine whether ink cartridge identification information in the instruction is BK, and if both of them are consistent, then it can be determined that the received instruction is BK ON, the received instruction may be referred to as the first light emitting control instruction. Likewise, an instruction corresponding to the sequence number 1 of the ink cartridge C is C ON, and when an instruction transmitted by the imaging device main body is received, with light control information included therein being ON and ink cartridge identification information being C, it is then determined that a first light emitting control instruction to be stored is received. Moreover, the first light emitting control instruction certainly needs to be executed.

Furthermore, it can be seen from the above ways that, a first instruction stored in the instruction storing module needs to include the light control information and the ink cartridge identification information, based on which it is determined whether what is received is this instruction. Instructions corresponding to other sequence number may use the ways described above, it may be identified through such as the ink cartridge identification information or through the preset indication information whether to execute.

Another alternative way is that, ink cartridge control units in ink cartridges provided in the imaging device main body may store the same light emitting control instructions, and for instance, store all instructions as shown in Table 4. In this case, when it is to determine whether the first light emitting control instruction received is the same as the first light emitting control instruction arranged according to the sequence, it needs to compare light control information and ink cartridge identification information, and when the ink cartridge control unit in each ink cartridge determines that the first instruction received by it is the same as the first instruction stored therein, then start counting, for instance, counting a time interval value or counting accumulated number.

When obtaining corresponding instructions according to time interval values or accumulated number recorded and counted by respective ink cartridge control units, each ink cartridge control unit determines whether the instruction needs to be executed according to ink cartridge identification information or an execution identifier; for instance, the ink cartridge control unit compares the ink cartridge identification information corresponding to the instruction, and if the ink cartridge identification information is the same as the ink cartridge identification information stored in a storage unit of the ink cartridge, then it indicates that the instruction needs to be executed. Or it is to determine whether the instruction is to be executed through preset indication information, i.e., an execution identifier, for instance, the execution identifier may also be accumulated number corresponding to the instruction and obtained by counting. For instance, for the ink cartridge C, assuming that the first instruction received by it is BK ON, then an instruction, accumulated number of which is obtained by counting and is 3, needs to be executed (i.e., C ON), and an instruction, accumulated number of which is 13, does not need to be executed (that is, M ON).

Another alternative way is that, ink cartridge control units in ink cartridges provided in the imaging device main body may store the same light emitting control instructions, and for instance, store all instructions as shown in Table 4; however, the same instructions correspond to different sequence number in different ink cartridge control units, for instance, in an ink cartridge control unit of the ink cartridge BK, the BK ON instruction corresponds to the sequence number 1, C ON corresponds to the sequence number 3, and when receiving BK ON, the ink cartridge BK then needs to start counting; whereas in an ink cartridge control unit of the ink cartridge C, although the BK ON instruction is stored, it is not provided with a sequence number, indicating that even though the instruction is received, neither execution nor processing is performed, ignoring the instruction; and C ON corresponds to the sequence number 1, when receiving C ON, the ink cartridge C then starts counting, similar to the first way above.

A processing principle of the ink cartridge control according to embodiments of the present invention is described in detail hereunder based on several specific examples.

Embodiment 9

This embodiment is described by taking an example where the instruction identification information counted is a time interval value between light emitting control instructions transmitted by the imaging device main body to at least two ink cartridges; moreover, an operating principle of the ink cartridge control unit is described from a systematical perspective of at least two ink cartridges in the entire imaging device main body.

Figure 18:
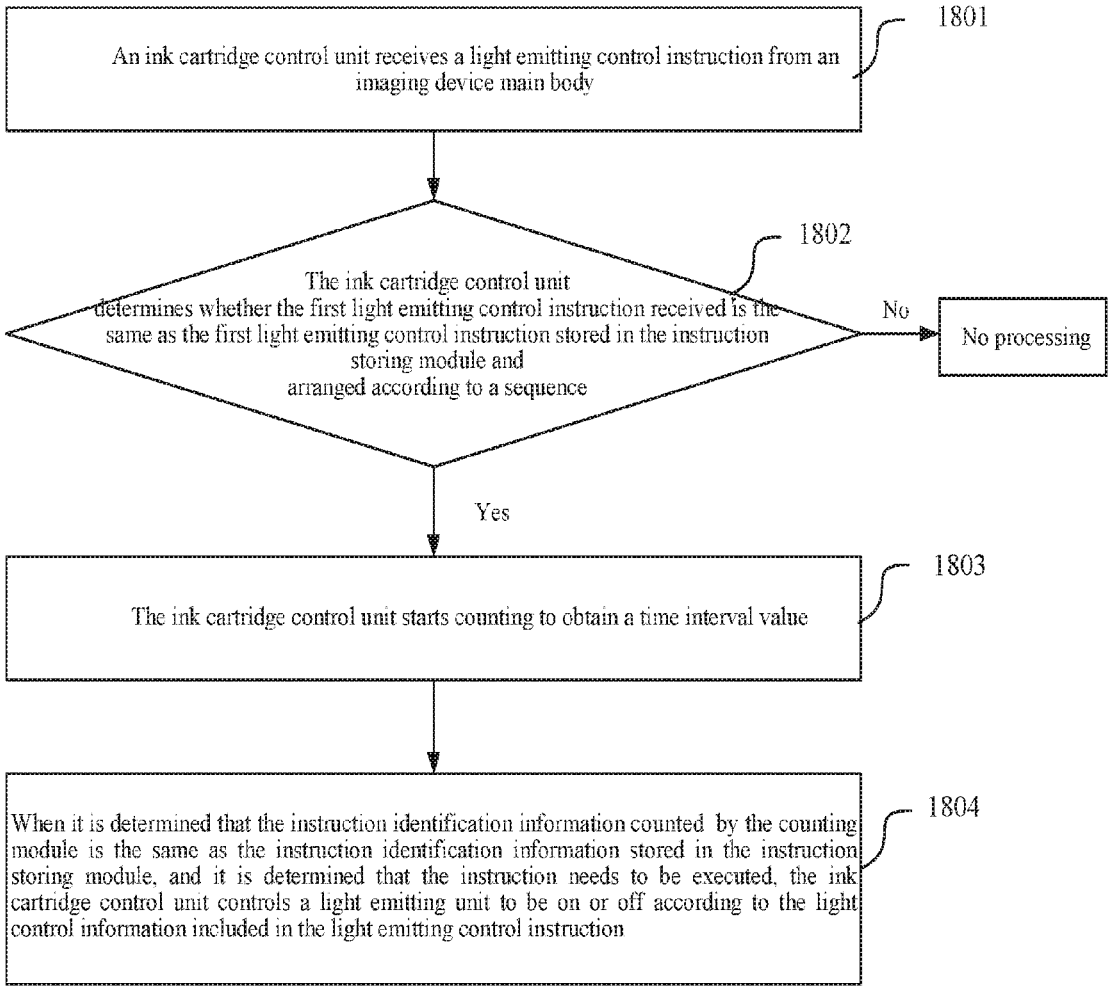
FIG. 18 is a flowchart of operating principle of an ink cartridge control unit according to an embodiment of the present invention.

According to an ink cartridge control unit in this embodiment, light emitting control instructions stored in the ink cartridge control unit in each ink cartridge are the same, which instructions are all instructions as shown in Table 4; moreover, in this embodiment, it is determined according to ink cartridge identification information whether the instruction is to be executed, that is, a light emitting control instruction stored in an instruction storing module of the ink cartridge control unit has a structure as shown in Table 1. FIG. 18 is a flowchart of operating principles of an ink cartridge control unit according to an embodiment of the present invention, as shown in FIG. 18, including:

1801, an ink cartridge control unit, configured to receive a light emitting control instruction from an imaging device main body;

Wherein ink cartridges are connected by a bus, so a light emitting control instruction transmitted by the imaging device main body to a certain ink cartridge can be received by each ink cartridge actually. The light emitting control instruction transmitted by the imaging device main body is in the form as shown in Table 1.

The ink cartridge control unit is connected to an interface unit in the ink cartridge, to receive at the interface unit a light emitting control instruction from the imaging device main body, and transmits the instruction to an instruction identifying module.

1802, the ink cartridge control unit, configured to determine whether the first light emitting control instruction received is the same as the first light emitting control instruction stored in the instruction storing module and arranged according to a sequence;

Wherein after receiving the light emitting control instruction, the instruction identifying module in the ink cartridge control unit will determine whether it is the same as the stored first light emitting control instruction. i.e., BK ON, and determine whether it is an ON instruction. The instruction identifying module of each ink cartridge can identify that the instruction is a light-on instruction, i.e., ON instruction, and is the same as the stored first light emitting control instruction, that is, the two instructions that is determined are the same, then continue to proceed with 1803; otherwise, the ink cartridge control unit does not perform the light emitting control instruction.

1803, the ink cartridge control unit, configured to start counting by timing to obtain a time interval value;

Wherein when the instruction identifying module in the ink cartridge control unit determines a result showing the same, a light control module of the ink cartridge control unit receives an instruction that the result determined by the instruction identifying module shows the same, then instruct a counting module in the ink cartridge control unit to start timing; each ink cartridge initiates the counting module for timing.

The counting module counts a time interval value between pair wise light emitting control instructions in light emitting control instructions. For instance, time point that BK ON is identified is taken as a starting point of timing, and when it reaches 800 ms, a corresponding instruction is BK OFF. In a specific embodiment, instruction identification information, i.e., 800 ms, which is obtained by the counting module through counting will be transmitted to the light control module in the ink cartridge control unit.

1804, the ink cartridge control unit, configured to control a light emitting unit to be on or off according to the light control information included in the light emitting control instruction, when it is determined that the instruction identification information counted by the counting module is the same as the instruction identification information stored in the instruction storing module, and that the instruction needs to be executed.

Wherein after the instruction identification information, i.e., 800 ms, Which is counted by the counting module, is transmitted to the light control module, the light control module will compare 800 ms is the same as instruction identification information corresponding to which instruction stored in the instruction storing module. For instance, a time interval between BK ON and BK OFF is 800 ms, which actually means that instruction identification information corresponding to BK OFF is 800 ms, and instruction identification information corresponding to BK ON is 0 ms (that is, a starting point of timing). The light control module will learn that an instruction with same instruction identification information is OFF.

Furthermore, the light control module will also determine whether an instruction is to be executed according to an execution identifier of the instruction. In this embodiment, it is to determine according to ink cartridge identification information whether the instruction is to he executed; for instance, in the determination of the ink cartridge BK, if the ink cartridge identification information in the instruction BK OFF is BK, which is the ink cartridge identification information stored in a storage unit of the ink cartridge BK itself, then it can be determined that the instruction needs to be executed. The light control module of the ink cartridge BK will control directly alight emitting unit to be off according to BK OFF, no matter whether the imaging device main body side transmits an BK OFF instruction at this time, or whether the ink cartridge control unit receives the BK OFF instruction transmitted by the imaging device main body, the above determination is made according to information counted by the counting module and the execution identifier completely, thereby getting rid of dependence on the received instruction.

Furthermore, when the ink cartridge BK receives BK ON and determines that the ink cartridge identification information in the received instruction is the same as the ink cartridge identification information in the storage unit of the ink cartridge, the ink cartridge BK will directly control a light emitting unit thereof to emit light.

It should be noted that, when the counting module obtains 800 ms by counting, counting modules of respective ink cartridges are cleared or reset for retiming, since this embodiment s described by taking an example where a time interval value between pairwise light emitting control instructions in light emitting control instructions is counted by the counting module.

Further, the time interval value may also be a time interval between any of other light emitting control instructions arranged according to a sequence that takes the first light emitting control instruction stored in the instruction storing module as a starting point and the first light emitting control instruction. For instance, when consecutive timing is performed by taking BK ON as a starting point, the time interval between the instruction C ON corresponding to the sequence number 3 and BK ON is 890.2 ms, and at this time, the counting module does not need to be cleared or reset, and when it counts to 800 ms, continue timing until 890.2 ms to obtain the corresponding C ON.

Embodiment 10

This embodiment is described by taking an example where the instruction identification information counted is accumulated number corresponded when each light emitting control instruction in light emitting control instructions transmitted by the imaging device main body to at least two ink cartridges occurs; moreover, an operating principle of the ink cartridge control unit is described from a systematical perspective of at least two ink cartridges in the entire imaging device main body.

Figure 19:
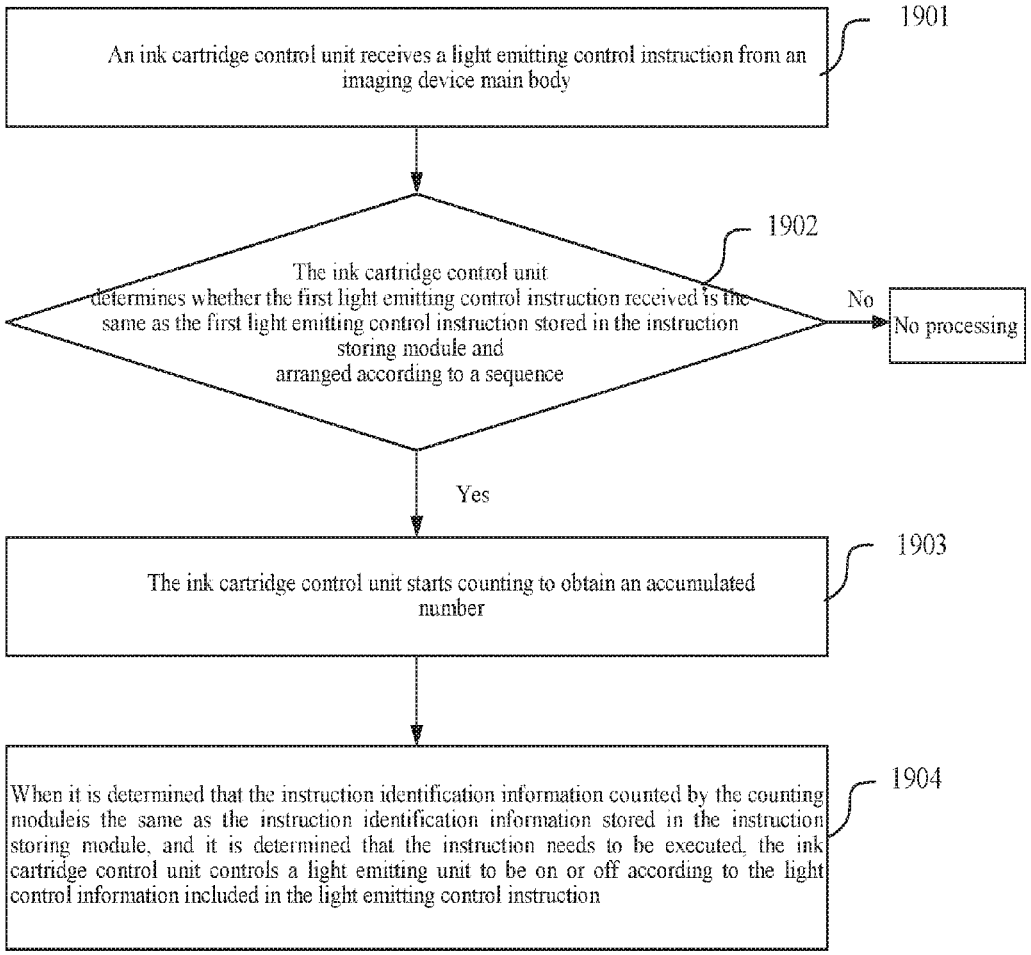
FIG. 19 is a flowchart of operating principle of an ink cartridge control unit according to another embodiment of the present invention.

According to an ink cartridge control unit in this embodiment, light emitting control instructions stored in the ink cartridge control unit in each ink cartridge are the same, and are all instructions as shown in Table 4; moreover, in this embodiment, ink cartridge identification information is taken as a standard for determining whether the instruction is to be executed, that is, a light emitting control instruction stored in an instruction storing module of the ink cartridge control unit has a structure as shown in Table 1. FIG. 19 is a flowchart of operating principles of an ink cartridge control unit according to another embodiment of the present invention, in which the steps that are the same as in FIG. 18 will not be described in detail any longer, including:

1901, an ink cartridge control unit, configured to receive a light emitting control instruction from an imaging device main body;

Wherein ink cartridges are connected by a bus, so a light emitting control instruction transmitted by the imaging device main body to a certain ink cartridge can be received by each ink cartridge actually. The light emitting control instruction transmitted by the imaging device main body is in the form as shown in Table 1.

The ink cartridge control unit is connected to an interface unit in the ink cartridge, to receive at the interface unit a light emitting control instruction from the imaging device main body, and transmits the instruction to an instruction identifying module.

1902, the ink cartridge control unit determines whether the first emitting control instruction received is the same as the first light emitting control instruction stored in the instruction storing module and arranged according to a sequence;

1903, the ink cartridge control unit, configured to start counting by timing to obtain an accumulated number;

Wherein when the instruction identifying module in the ink cartridge control unit determines a result showing the same, alight control module of the ink cartridge control unit receives an instruction that the result determined by the instruction identifying module shows the same, and then instructs a counting module in the ink cartridge control unit to start timing; each ink cartridge initiates the counting module for timing.

The counting module counts accumulated number corresponded when each light emitting control instruction arranged according to a sequence that takes the first light emitting control instruction stored in the instruction storing module as a starting point occurs. For instance, BK ON corresponds to accumulated number 1, BK OFF corresponds to accumulated number 2, and C ON corresponds to accumulated number 3, etc. In a specific implementation, instruction identification information, i.e., the accumulated number, which is counted by the counting module through counting, will be transmitted to the light control module in the ink cartridge control unit.

1904, the ink cartridge control unit, configured to control a light emitting unit to be on or off according to the light control information included in the light emitting control instruction, when it is determined that the instruction identification information counted by the counting module through counting is the same as the instruction identification information stored in the instruction storing module, and that the instruction needs to be executed.

Where after the instruction identification information, i.e., the accumulated number, which is counted by the counting module, is transmitted to the light control module, the light control module will compare that the accumulated number is the same as instruction identification information corresponding to which instruction stored in the instruction storing module. For instance, BK OFF corresponds to accumulated number 2, and the light control module obtains according to counted number transmitted by the counting module that a corresponding instruction is OFF.

Furthermore, the control module will also determine whether the instruction is to be executed according to ink cartridge identification information of the instruction; for instance, in the determination of the ink cartridge BK, if the ink cartridge identification information in the instruction BK OFF is BK, which is the ink cartridge identification information stored in a storage unit of the ink cartridge BK itself, then it can be determined that the instruction needs to be executed. The light control module the ink cartridge BK will control directly a light emitting unit to be off according to BK OFF, no matter whether the imaging device main body side transmits an BK OFF instruction at this time, or whether the ink cartridge control unit receives the BK OFF instruction transmitted by the imaging device main body, a determination is made according to information counted by the counting module and an execution identifier completely, thereby getting rid of dependence on the instruction received.

Furthermore, the accumulated number may also be accumulated number corresponded when each light emitting control instruction is arranged according to sequence of appearance in a type of control instructions to which the light emitting control instruction belongs. For instance, C ON has accumulated number of 2 in the type of ON, and BK ON is before it, then the ink cartridge control unit may determine which ON instruction is received.

Alternatively, the above embodiments are described by taking ink cartridge identification information in a light emitting control instruction as an example, wherein each ink cartridge determines whether the instruction is to be executed according to the ink cartridge identification information of the instruction; in a specific implementation, the execution identifier may also be preset indication information used for indicating whether the light emitting control instruction needs to be executed, and in this case, the light emitting control instruction stored includes ink cartridge identification information and light control information, only that it is based on the execution identifier rather than the ink cartridge identification information to determine whether the instruction is to be executed at this time. For instance, in order to ensure sufficient amount of light of an ink cartridge light emitting unit during position detection, the ink cartridge performs control of light emission only according to light control information in a light emitting control instruction, and at this time, since a plurality of ink cartridges are connected by a shared line, the plurality of ink cartridges will be on or off simultaneously. Moreover, when opening and closure of the light emitting unit are controlled in such a manner, it should be noted that, here the preset indication information stored in the storing module is configured to indicate whether each light emitting control instruction is executed. For instance, BK ON and BK off which occur for the second time as shown in Table 1 do not need to be executed, since it is the adjacent position light detection stage at this time, and if light emitting units of the ink cartridges emit light simultaneously, it will fail to pass the detection of the adjacent position light detection stage. For this reason, light emitting control instructions prestored above need to be divided according to the facing position light detection stage and the adjacent position light detection stage, setting different preset indication information to selectively execute.

It should be noted that, in the ink cartridge control unit according to embodiments of the present invention, division of modules is not limited to the instruction storing module and the counting module described in the embodiments above, other division manners of the modules may be used; and processing performed by the modules is not limited to the processing described in the embodiments above, for instance, it may also use the counting module to determine whether the instruction identification information counted is the same as the instruction identification information corresponding to the light emitting control instruction as stored in the instruction storing module, etc. No matter how the modules are divided and by which module the processing is performed, as long as the processing performed by the ink cartridge control unit according to embodiments of the present invention is executed, they all fall into the protection scope of the present invention.

Embodiment 11

This embodiment provides a circuit board for controlling light emission of an ink cartridge, including: an interface unit for receiving a signal transmitted by an imaging device main body, a storage unit for storing ink cartridge identification information, and an ink cartridge control unit according to any embodiment of the present invention. Reference may be made to the above embodiments for structure of the ink cartridge control unit, which will not be repeated herein.

Alternatively, the circuit board for controlling light emission of the ink cartridge may include: alight emitting unit, which is connected to the ink cartridge control unit and is configured to emit light towards an light receiver on the imaging device main body according to control of the ink cartridge control unit.

Embodiment 12

This embodiment provides an ink cartridge, including an ink cartridge main body, and further including: a circuit board for controlling light emission of an ink cartridge according to any embodiment of the present invention.

Persons of ordinary skill in the art may understand that, besides using the manner of wired connection such as electrical contacts mentioned in the embodiments above, the interface unit in the ink cartridge may also use a manner of wireless connection.

Furthermore, the ink cartridge further includes a light emitting unit, which may emit light towards an light receiver provided on the imaging device main body, and is connected to the ink cartridge control unit; the light emitting unit is provided on the ink cartridge main body or the light emitting control circuit board.

Embodiment 13

The embodiment of the preset invention also provide an imaging device, including an imaging device main body and at least two ink cartridges, where the ink cartridges use an ink cartridge described in any embodiment of the present invention.

Persons of ordinary skill in the art may understand that, all or a part of the steps of the foregoing method embodiments may be implemented by a program instruction related hardware. The foregoing program may be stored in a computer readable storage medium. When the program runs, the steps of the foregoing method embodiments are performed. The foregoing storage medium includes various mediums capable of storing program codes, such as an ROM, an RAM, a magnetic disk, or an optical disc.

It will be understood by persons of ordinary skill in the art that, "a plurality of ink cartridges are on or off simultaneously", besides using the manner of controlling the light emitting unit according to the light control information in the light emitting control instruction only, may also use a manner of storing ink cartridge identification information of a plurality of ink cartridges in the storage unit of each ink cartridge. As described above, since the plurality of ink cartridges are connected by a bus (shared line), a light emitting control instruction transmitted by the ink jet printer each time will be received by a control unit of each ink cartridge, then the control unit acquires the ink cartridge identification information and the light control information in the light emitting control instruction and then compares the ink cartridge identification information of the light emitting control instruction with a plurality of ink cartridge identification information prestored in the storage unit, and if the plurality of ink cartridge identification information include the ink cartridge identification information in the light emitting control instruction, then the control unit of each ink cartridge will control each light emitting unit to be on or off according to the light control information.

It will be understood by persons of ordinary skill in the art that, when "an execution identifier" is used to determine whether the light emitting control instruction is to be executed, the light emitting unit of each ink cartridge may also be controlled to open/close according to the ink cartridge identification information. Specifically, if the ink cartridge identification information in the light emitting control instruction transmitted by the imaging device main body is consistent with the ink cartridge identification information prestored in the ink cartridge, then the light emitting unit may be controlled to be on or off according to light control information in the light emitting control instruction at this time; and if both of them are inconsistent, then there is no need to execute the light emitting control instruction.

Persons of ordinary skill in the art may understand that, all or a part of the steps of the foregoing method embodiments may be implemented by a program instruction related hardware. The foregoing program may be stored in a computer readable storage medium. When the program runs, the steps of the foregoing method embodiments are performed. The foregoing storage medium includes various mediums capable of storing program codes, such as an ROM, an RAM, a magnetic disk, or an optical disc.

Finally, it should be noted that the foregoing embodiments are merely intended to describe technical solutions of the present invention rather than limiting the present invention. Although the present invention has been described in detail with reference to the foregoing embodiments, it will be understood by persons of ordinary skill in the art that it may still make modifications to the technical solutions described in the foregoing embodiments, or make equivalent replacements for some or all technical features therein; however, these modifications or replacements do not make the essence of corresponding technical solutions depart from the scope of the technical solutions of the embodiments of the present invention.

Embodiment 14

Figure 20:
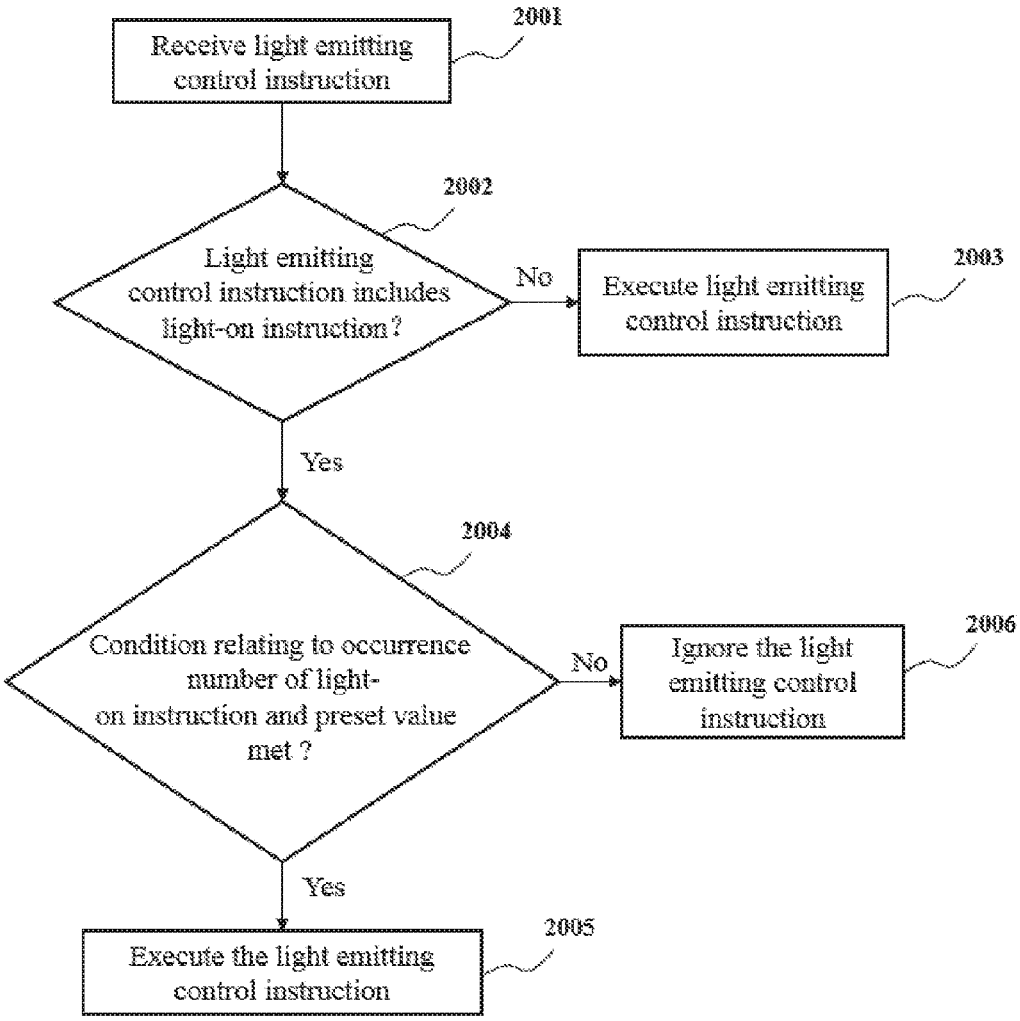
FIG. 20 is a flowchart of an exemplary process of controlling light emission of an ink cartridge according to some embodiments of the present disclosure.

FIG. 20 is a flowchart of an exemplary process of controlling light emission of the ink cartridge according to some embodiments of the present disclosure. The ink cartridge control unit may control the light emission of the light emitting unit according to an occurrence number of the light-on instructions. As illustrated in FIG. 20, at 2001, the ink cartridge control unit may receive a light emitting control instruction from the imaging device main body on which the ink cartridge is installed. At 2002, the ink cartridge control unit may determine whether the light emitting control instruction includes a light-on instruction. The determination may be based on the light control information included in the light emitting control information.

In some embodiments, if the ink cartridge control unit determines that the light emitting control instruction does not include a light-on instruction (e.g., the ink cartridge control unit may determine that the light emitting control instruction includes a light-off instruction), the ink cartridge control unit, at 2003, may execute the light emitting control instruction. On the other hand, if the ink cartridge control unit determines that the light emitting control instruction includes a light-on instruction, the ink cartridge control unit may, at 2004, compare an occurrence number of the light-on instruction with a preset value and determine whether a condition is met based on the comparison. For example, the ink cartridge control unit may compare the occurrence number of the light-on instruction with the preset value and determine that the condition that the occurrence number of the light-on instruction equals to the preset value is met.

if the condition is not met (e.g., the occurrence number of the light-on instruction does not equals to the preset value), the ink cartridge control unit may, at 2006, choose not to execute the light emitting control instruction (or the light-on instruction included therein). On the other hand, if the condition is met (e.g., the occurrence number of the light-on instruction equals to the preset value), the ink cartridge control unit may, at 2005, execute the light emitting control instruction (or the light-on instruction included therein) and control the light emitting unit to emit light.

As described elsewhere in this disclosure, facing position detection and relative position detection may be performed for the ink cartridges of the imaging device. During the facing position detection stage and/or the adjacent position detection stage, the imaging device main body may transmit to the ink cartridge control unit a light-on instruction and a light-off instruction, respectively. In some embodiments, the determination of whether to execute the light emitting control instruction may be based on a counting number of the light-on instruction, and the preset value may be set according to the sequence of the light-on instruction from the main body of the imaging device.

A part of an exemplary light emitting control instruction, as illustrated in TABLE 6 is described below solely for purposes of illustrating the setting of the preset value, and is not intended to limit the scope of the present disclosure.

TABLE 6

Accumulated Number of Light Control Instructions

| Transmission sequence | Light emitting control instruction | Detection stage | Accumulated number 1 | Accumulated number 2 |
|---|---|---|---|---|
| 1 | BK ON | P | 1 | 1 |
| 2 | BK OFF | | | 2 |
| 3 | C ON | N | 2 | 3 |
| 4 | C OFF | | | 4 |
| 5 | C ON | P | 3 | 5 |
| 6 | C OFF | | | 6 |
| 7 | BK ON | N | 4 | 7 |
| 8 | BK OFF | | | 8 |
| 9 | M ON | P | 5 | 9 |
| 10 | M OFF | | | 10 |

For instance, the preset value may be accumulated number of the light-on instruction corresponded that sequentially occur at the facing position light detection stage. As shown in Table 6, the accumulated numbers of light-on instruction corresponding to a plurality of facing position light detection stages may be 1, 3, and 5, respectively. And the corresponding accumulated numbers of light emitting control instruction are 1, 5, and 9, respectively. The preset value may be set as 1, 3, or 5. Thus, according to the process illustrated in FIG. 20, if a light-on instruction is corresponding to a facing position light detection stage, the light-on instruction may be executed; and if the light-on instruction is corresponding to an adjacent position light detection stage, the light-on instruction may be ignored.

It should be noted that the above description of this embodiment is merely provided for the purpose of illustration, and not intended to limit the scope of the present disclosure. For person having ordinary skill in the art, multiple variations and modifications may be made under the teachings of the present disclosure. For example, the step 2004 may be modified to determine whether an occurrence number of the light-on instruction does not equal to a preset value. If the occurrence number of the light-on instruction is not accumulated to a preset value, the process may proceed to step 2005 and the light emitting control instruction may be executed; if the occurrence number of the light-on instruction is accumulated to the preset value, the process may proceed to step 2006 and the light emitting control instruction may be ignored. In some embodiments, The preset value may also be set as accumulated number of the light emitting control instruction corresponded to the facing position light detection stage or the adjacent position light detection stage. The determination method may be modified according to the setting of the preset value.

What is claimed is:

1. A method for controlling light emission of a first ink cartridge, the first ink cartridge and a second ink cartridge being removably mounted to an imaging device main body, the first ink cartridge including an ink cartridge control unit, a light emitting unit, and a storage, the method comprising:
- receiving from the imaging device main body, by the ink cartridge control unit, a light emitting control instruction; and
- controlling, by the ink cartridge control unit, light emission of a light emitting unit of the first ink cartridge based, at least in part, on the light emitting control instruction and preset control information, the preset control information being stored in the storage, wherein
  - the light emitting unit emits a light at a facing-position-light-detection stage of the second ink cartridge, and
  - the light emitting unit does not emit a light at an adjacent-position-light-detection stage of the second ink cartridge.

2. The method of claim 1, wherein the light emitting control instruction includes ink cartridge identification information and light emitting control information.

3. The method of claim 2, wherein controlling the light emission of the light emitting unit is based on the light emitting control information independent of the ink cartridge identification information.

4. The method of claim 1, wherein the light emitting control instruction includes a light-on instruction.

5. The method of claim 4, wherein controlling, by the ink cartridge control unit, the light emission of the light emitting unit based, at least in part, on the light emitting control instruction and preset control information includes:
- executing the light emitting control instruction according to an occurrence number of the light emitting control instruction or an occurrence number of the light-on instruction.

6. The method of claim 5, wherein executing the light emitting control instruction according to the occurrence number of the light emitting control instruction or the occurrence number of the light-on instruction includes:
- determining whether the occurrence number of the light-on instruction or the occurrence number of the light emitting control instruction equals to a preset value; and
- executing the light-on instruction based on a result of the determination.

7. The method of claim 5, wherein executing the light emitting control instruction according to the occurrence number of the light-on instruction includes:
- determining whether the occurrence number of the light-on instruction o occurrence number of the light emitting control instruction equals to a preset value; and
- executing the light emitting control instruction based on a result of the determination.

8. The method of claim 6, wherein executing the light-on instruction includes:
- starting a delay timing;
- determining whether the delay timing equals to or exceeds a preset delay threshold value, and
- executing the light-on instruction based on a result of the determination of whether the delay timing equals to or exceeds the preset delay threshold value.

9. The method of claim 8, wherein the preset delay threshold value is equal to or less than a time interval at the facing position light detection stage of the second ink cartridge.

10. The method of claim 5, wherein:
- the light emitting control instruction includes a light-off instruction, and
- the controlling, by the ink cartridge control unit, light emission of the light emitting unit based, at least in part, on the light emitting control instruction and preset control information further includes:
  - starting a delay timing;
  - determining whether the delay timing equals to or exceeds a preset delay threshold value; and
  - executing the light-off instruction based on a result of the determination of whether the delay timing equals to or exceeds the preset delay threshold value.

11. An ink cartridge being removably mounted to an imaging device main body, the ink cartridge comprising:
- alight emitting unit configured to emit a light;
- a storage; and
- a control unit configured to:
  - receive, from the imaging device main body, alight emitting control instruction; and
  - control light emission of the light emitting unit based, at least in part, on the light emitting control instruction and preset control information, the preset control information being stored in the storage, wherein
    - the light emitting unit emits a light at a facing-position-light-detection stage of another ink cartridge, and
    - the light emitting unit dose not emit alight at an adjacent-position-light-detection stage of the another ink cartridge.

12. The ink cartridge of claim 11, wherein the light emitting control instruction includes ink cartridge identification information and light emitting control information.

13. The ink cartridge of claim 12, wherein the control unit configured to control the light emission of the light emitting unit is based on the light emitting control information independent of the ink cartridge identification information.

14. The ink cartridge of claim 11, wherein the light emitting control instruction includes a light-on instruction.

15. The ink cartridge of claim 14, wherein the control unit configured to control the light emission of the light emitting unit based, at least in part, on the light emitting control instruction and preset control information includes:
- executing the light emitting control instruction according to an occurrence number of the light emitting control instruction or an occurrence number of the light-on instruction.

16. The ink cartridge of claim 15, wherein executing the light emitting control instruction according to an occurrence number of the light emitting control instruction or an occurrence number of the light-on instruction includes:

determining whether the occurrence number of the light-on instruction or the occurrence number of the light emitting control instruction equals to a preset value; and executing the light-on instruction based on a result of the determination.

17. The ink cartridge of claim 15, wherein executing the light emitting control instruction according to the occurrence number of the light-on instruction includes:

determining whether the occurrence number of the light-on instruction or the occurrence number of the light emitting control instruction equals to a preset value; and executing the light emitting control instruction based on a result of the determination.

18. The ink cartridge of claim 16, wherein executing the light-on instruction includes:

starting a delay timing;

determining whether the delay timing equals to or exceeds a preset delay threshold value; and executing the light-on instruction based on a result of the determination of whether the delay timing equals to or exceeds the preset delay threshold value.

19. The ink cartridge of claim 18, wherein the preset delay threshold value is equal to or less than a time interval at the facing position light detection stage of the another ink cartridge.

20. The ink cartridge of claim 15, wherein:

the light emitting control instruction includes a light-off instruction, and the control unit configured to control the light emission of the light emitting unit based, at least in part, on the light emitting control instruction and preset control information further includes:

starting a delay timing;

determining whether the delay timing equals to or exceeds a preset delay threshold value; and executing the light-off instruction based on a result of the determination of whether the delay timing equals to or exceeds the preset delay threshold value.

* * * * *